US010703527B2

(12) United States Patent
Apps et al.

(10) Patent No.: US 10,703,527 B2
(45) Date of Patent: Jul. 7, 2020

(54) BEVERAGE CRATE

(71) Applicant: Rehrig Pacific Company, Los Angeles, CA (US)

(72) Inventors: Shelby Frances Apps, Brookhaven, GA (US); Suzanne Whitfield Clark, Santa Monica, CA (US); William P. Apps, Alpharetta, GA (US); Crystal Y. Parra, Downey, CA (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 15/919,366

(22) Filed: Mar. 13, 2018

(65) Prior Publication Data

US 2019/0248533 A1 Aug. 15, 2019

Related U.S. Application Data

(60) Provisional application No. 62/483,841, filed on Apr. 10, 2017, provisional application No. 62/474,989, filed on Mar. 22, 2017, provisional application No. 62/470,854, filed on Mar. 13, 2017.

(51) Int. Cl.
*B65D 1/24* (2006.01)
*B65D 21/02* (2006.01)

(52) U.S. Cl.
CPC ..... *B65D 1/243* (2013.01); *B65D 21/0233* (2013.01); *B65D 2501/2407* (2013.01); *B65D 2501/24019* (2013.01); *B65D 2501/2435* (2013.01); *B65D 2501/24114* (2013.01); *B65D 2501/24152* (2013.01); *B65D 2501/24248* (2013.01); *B65D 2501/24261* (2013.01);
(Continued)

(58) Field of Classification Search
CPC ..... B65D 1/243; B65D 21/0233; B65D 2501/24019; B65D 2501/2407; B65D 21/0212; B65D 2501/24108; B65D 2501/24114; B65D 2501/24152; B65D 2501/24248; B65D 2501/24261; B65D 2501/2435; B65D 2501/24541; B65D 2501/24687; B65D 2501/24872
USPC ..... 206/427, 505, 509, 459.5; 220/506, 516
See application file for complete search history.

(56) References Cited

U.S. PATENT DOCUMENTS 5,445,273 A * 8/1995 Apps ..... B65D 1/243 206/505
7,086,531 B2 * 8/2006 Apps ..... B65D 1/243 206/509
(Continued)

*Primary Examiner* — Chun Hoi Cheung
(74) *Attorney, Agent, or Firm* — Carlson, Gaskey & Olds, P.C.

(57) ABSTRACT

A beverage crate includes a base having opposed end edges and opposed side edges. A pair of end walls extending upward from the end edges of the base. A pair of side walls extend upward from the side edges of the base. Each of the side walls includes an upper band portion connected to the base by inwardly-offset columns. The upper band portions each include at least one upper peak protruding upwardly and at least one complementary recess aligned below the at least one upper peak. The upper band portions each include at least one lower peak protruding downwardly and at least one complementary recess aligned above the at least one lower peak.

22 Claims, 44 Drawing Sheets

(52) U.S. Cl.
CPC ..... *B65D 2501/24541* (2013.01); *B65D 2501/24687* (2013.01); *B65D 2501/24872* (2013.01)

(56) References Cited

U.S. PATENT DOCUMENTS

| | | | | |
|---|---|---|---|---|
| 7,581,643 | B2 * | 9/2009 | Wilskey | B65D 33/105 206/278 |
| 8,056,753 | B2 * | 11/2011 | Koefelda | B65D 1/22 206/519 |
| 8,474,617 | B2 * | 7/2013 | Wiedmann | B65D 1/243 206/427 |
| 8,960,479 | B2 * | 2/2015 | Meers | B65D 1/243 206/505 |
| 2001/0015329 | A1 * | 8/2001 | Apps | B65D 1/243 206/427 |
| 2001/0019063 | A1 * | 9/2001 | Apps | B65D 1/22 220/771 |
| 2014/0110303 | A1 * | 4/2014 | Meers | B65D 21/0233 206/775 |
| 2016/0016689 | A1 * | 1/2016 | Apps | B65D 1/243 206/141 |

* cited by examiner 128
130
110

126
114
116
120
124
110

122
118
126
112

BEVERAGE CRATE

BACKGROUND

Generally, many beverage crates include a base, a pair of opposed side walls and a pair of opposed end wall. The side walls and end walls may include a band portion and columns connecting the band portion to the base. The columns are offset inwardly of the band portion so that the base and columns of one crate can be nested within the side walls and end walls of an empty crate. This reduces stacking height when shipping and storing empty crates.

SUMMARY

Multiple beverage crate designs are disclosed herein. Several features are common to one or more of the disclosed designs and any of the features could be used in any combination. In several designs, asymmetrical contoured band designs effectively create an extended band height without increasing the height of nest. The extended height paired with the asymmetry of the bands prevents side-by-side "shingling" that occurs when one band of a crate gets caught on top of the band of an adjacent lower crate as it is being placed next to the lower crate.

The asymmetry of the protruding shapes in the bands also creates instability when the crate is turned upside down. This prevents using the crate for display, therefore reducing the motivation for theft.

The protruding contour shapes in the band lock with the crates above and below when nested. This provides a more stable stack of empty, nested crates. The contour shapes of the bands act as a "locating features" when nesting crates together.

Optionally, the contour shapes in the bands are positioned to stabilize large multi-serving (in this example, 1.75 L) bottles while maintaining label visibility.

DETAILED DESCRIPTION OF PREFERRED EMBODIMENTS

Figure 1:
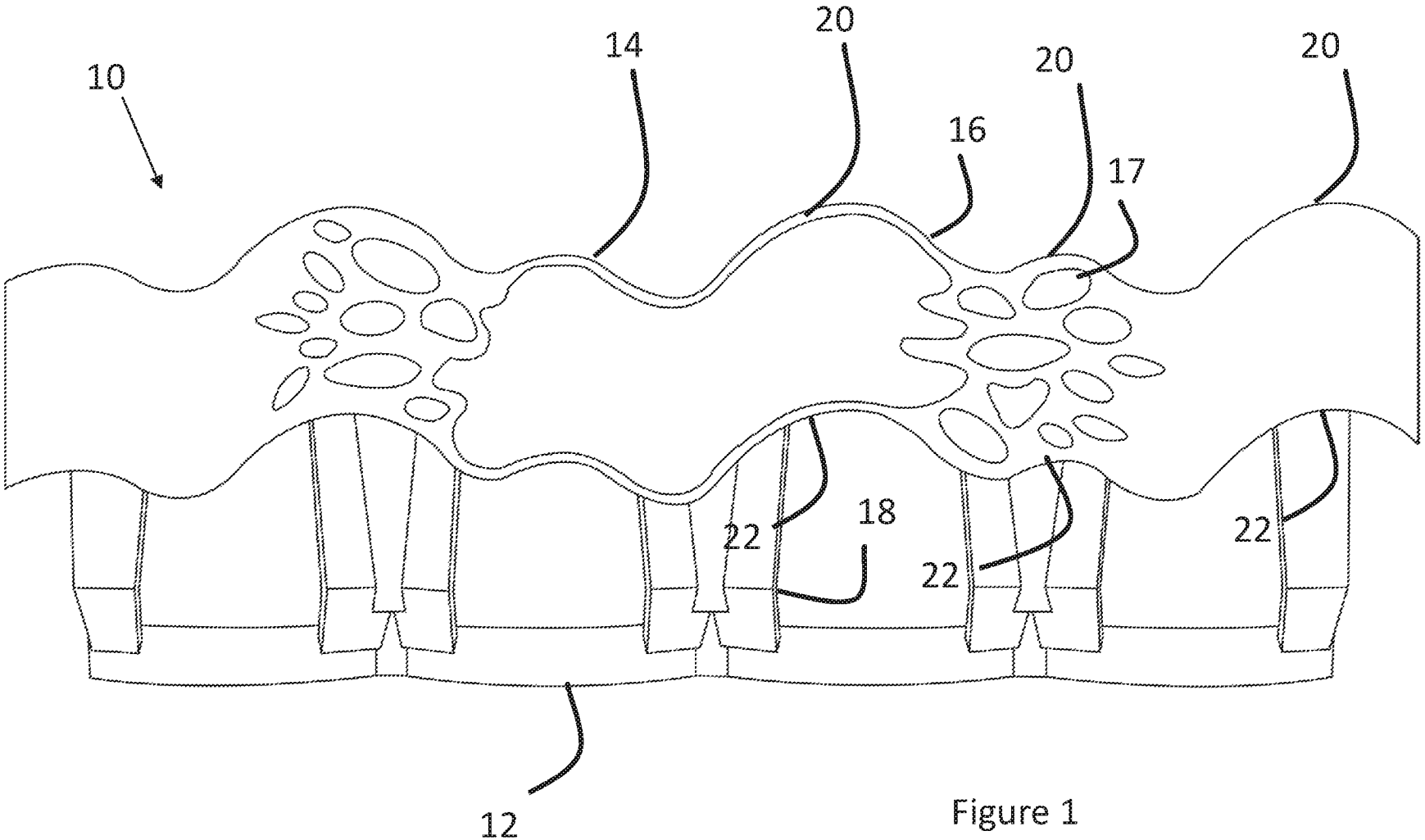
FIG. 1 is a side view of a crate according to a first embodiment.
Figure 2:
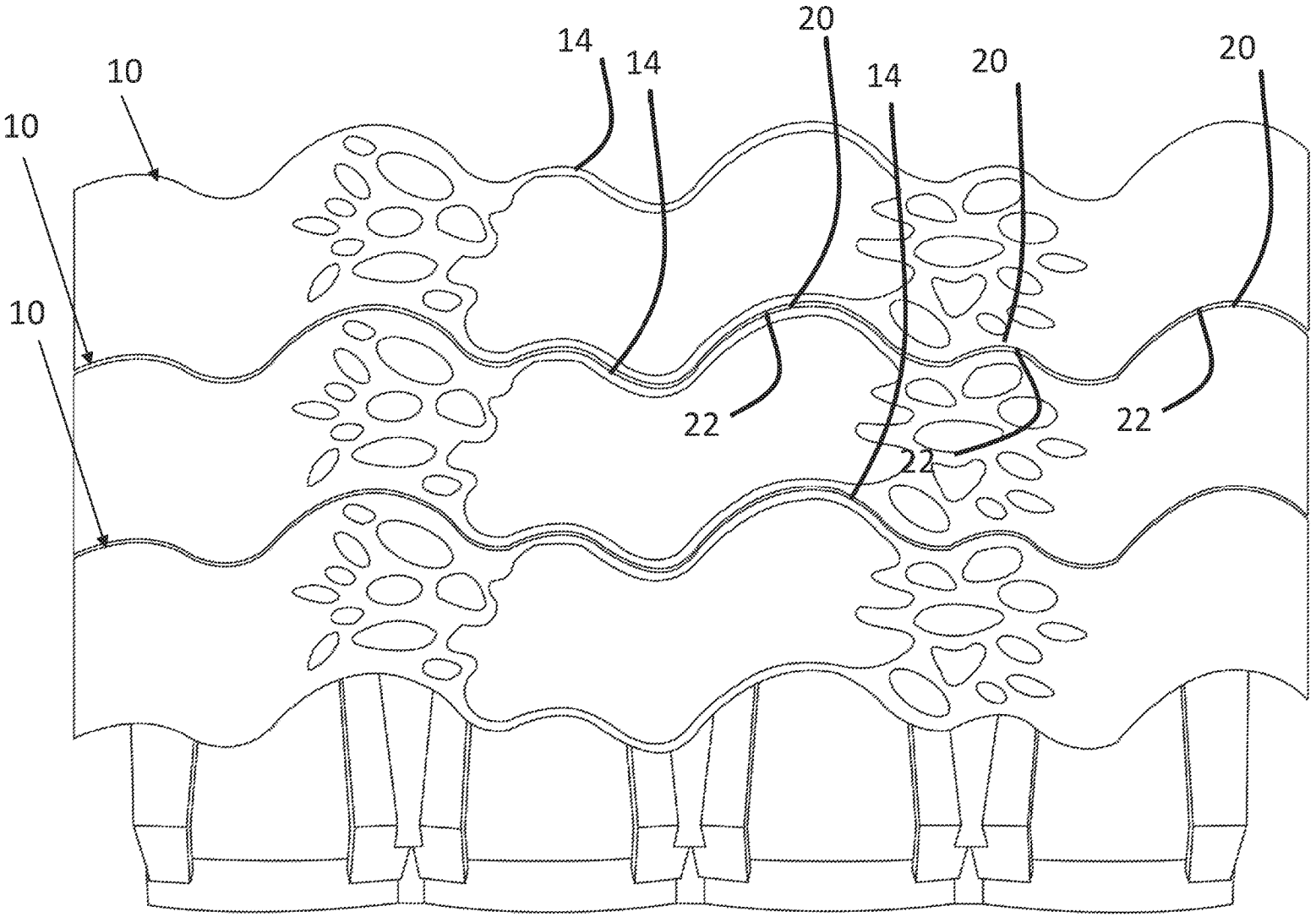
FIG. 2 is a side view of three empty crates of FIG. 1 nested together.
Figure 3:
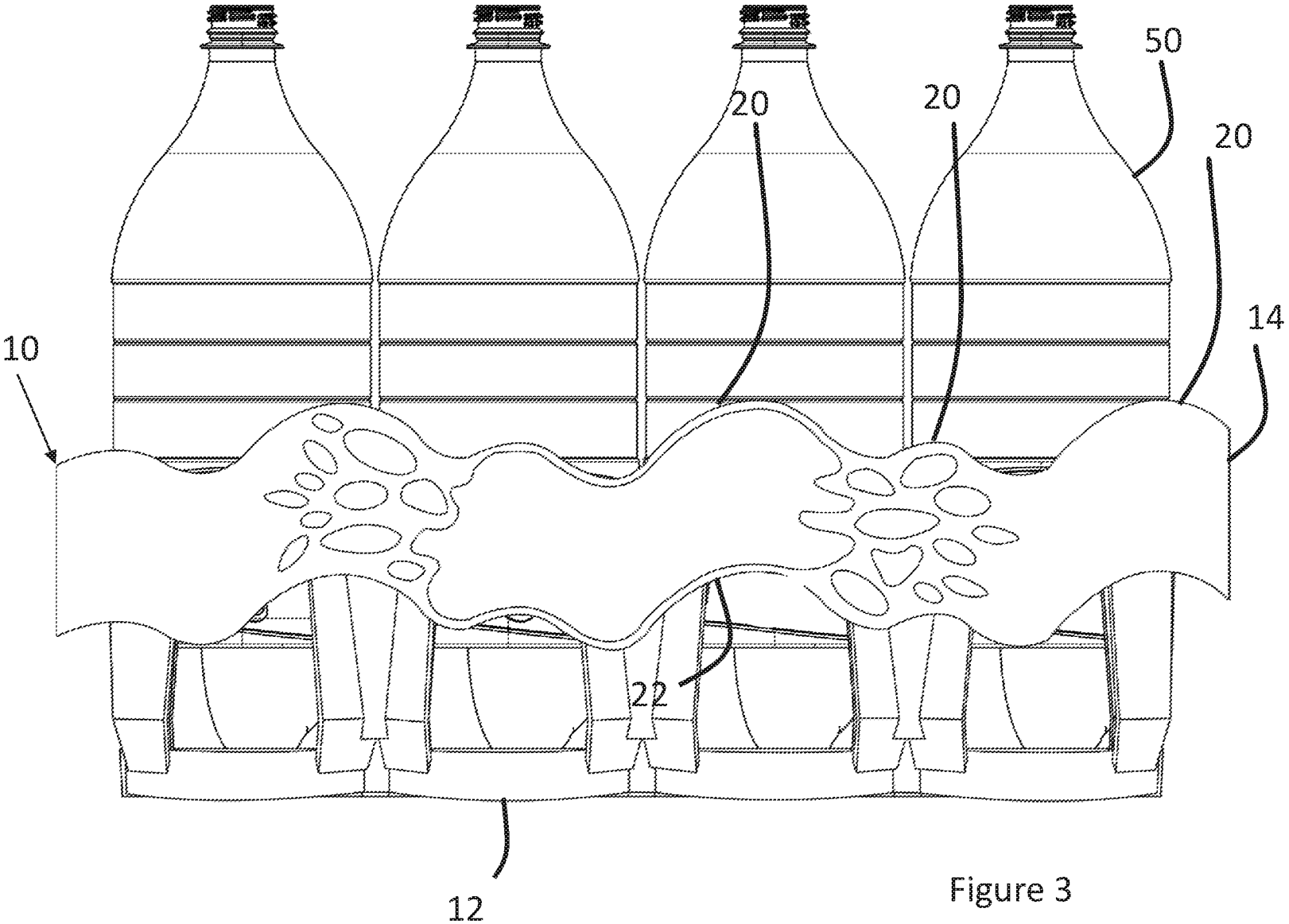
FIG. 3 is a side view of the crate of FIG. 1 loaded with bottles.

A first crate 10 is shown in FIGS. 1-3. Referring to FIG. 1, the crate 10 includes a base 12 and side walls 14 extending upward from the base 12. The side walls 14 include a band portion 16 connected to the base 12 by inwardly-offset columns 18. As shown, the band portion 16 of the side wall 14 is asymmetrical (left/right) and has upper and lower edges that rise and fall together to form a plurality of peaks 20 on the upper edge and a plurality of recesses 22 formed on the lower edge of the band portion 16. A plurality of design shapes 17 may be molded into the exterior surface of the band portion 16. The crate 10 is injection molded as a single piece of suitable plastic. In this example, the opposite side wall 14 (not visible in FIG. 1) is identical to the side wall 14 of FIG. 1. This would result in the misalignment of peaks 20 and recesses 22 of adjacent band portions 16 of two adjacent crates 10, which would reduce the likelihood of them shingling. Alternatively, the other side wall 14 could be the mirror image of the side wall 14 of FIG. 1; however, it would not have the advantage of the misaligned peaks 20 and recesses 22 of adjacent band portions 16 of two adjacent crates 10.

As shown in FIG. 2, the peaks 20 of a lower crate 10 are received in the recesses 22 of an upper crate 10 nested therein. This provides a very stable nested stack of crates 10. The base 12 of the upper crate 10 is received between the side walls 14 of the crate 10 to reduce stacking height.

FIG. 3 shows the crate 10 with a plurality of large multi-serving bottles 50 stored therein, in this example 1.75 L plastic bottles. Each of the bottles 50 has an aligned peak 20 to improve the stability of the bottle 50. Some of the recesses 22 in the bottom edge of the band portion 16 align with the label on the bottle 50 to increase label visibility.

Figures 4, 5:
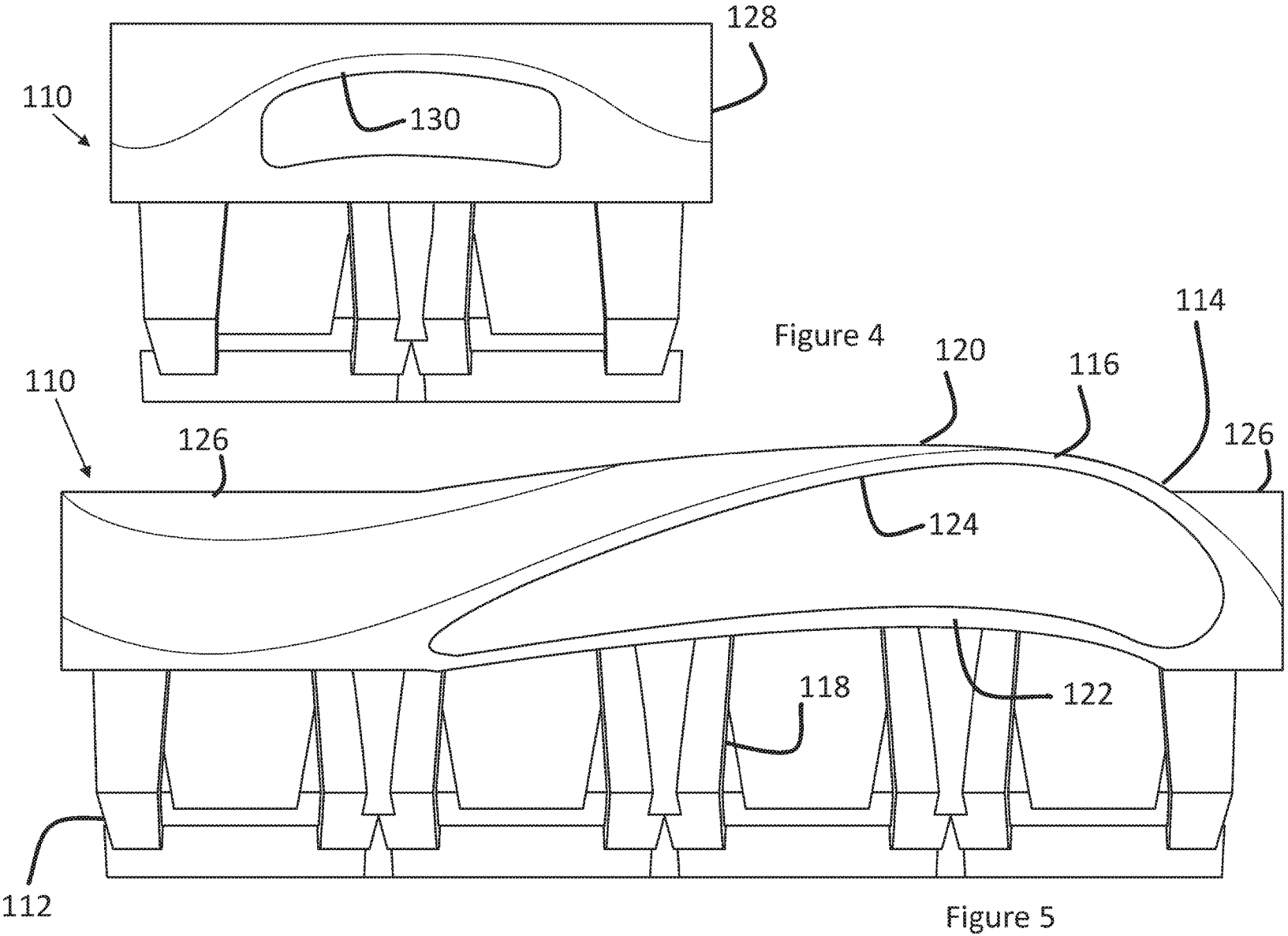
FIG. 4 is an end view of a crate according to a second embodiment.
FIG. 5 is a side view of the crate of FIG. 4.

A second crate 110 is shown in FIGS. 4-8. Referring to FIGS. 4-5, the crate 110 includes a base 112 with side walls 114 and end walls 128 extending upward from the base 112. Handle openings 130 are formed in the end walls 128. The side walls 114 include a band portion 116 connected to the base 112 by inwardly-offset columns 118. As shown, the band portion 116 of the side wall 114 is asymmetrical (left/right) and has upper and lower edges that rise and fall together to form a peak 120 extending upward at the upper edge and a recess 122 formed on the lower edge of the band portion 116. A logo area 124 may be molded into the exterior surface of the band portion 116. The band portion 16 may also include flat areas 126 adjacent ends of the crate 110 on either side of the peak 120. The upper and lower edge of the band portion 116 are generally horizontal and flat in the flat areas 126. The crate 110 is injection molded as a single piece of suitable plastic. Again, the other side wall 114 (not visible) is preferably identical, but alternatively could be mirror image.

Figures 6, 7:
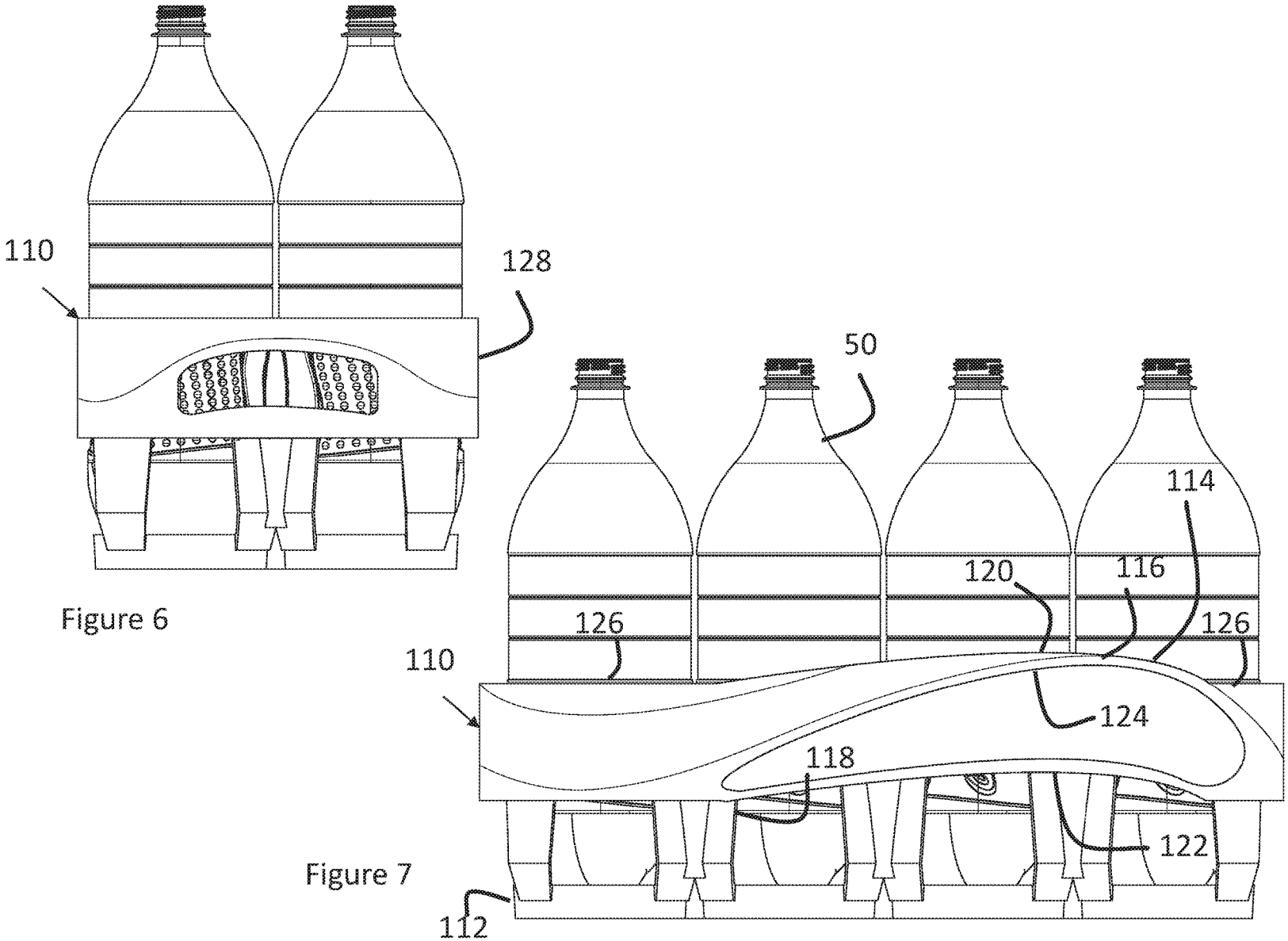
FIG. 6 is an end view of the crate of FIG. 4, loaded with bottles.
FIG. 7 is a side view of the crate and bottles of FIG. 6.

FIGS. 6 and 7 show the crate 110 with a plurality of large multi-serving bottles 50 stored therein, in this example 1.75 L plastic bottles. The peak 120 aligns with one or more of the bottles 50 to improve stability. The recess 122 in the bottom edge of the band portion 116 aligns with the label on the bottle 50 to increase label visibility.

Figure 8:
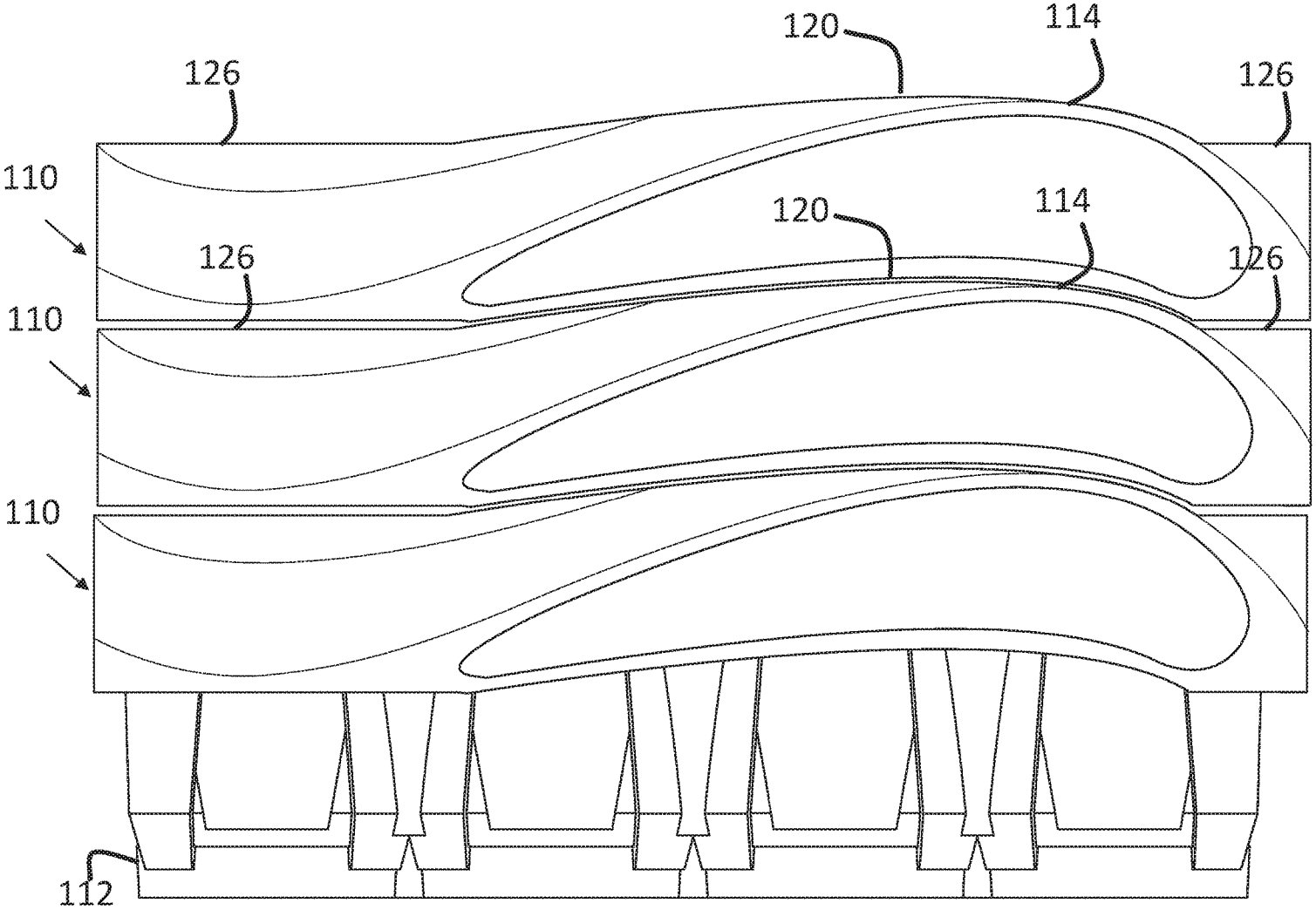
FIG. 8 is a side view of three empty crates of FIG. 4 nested together.

As shown in FIG. 8, the peaks 120 of a lower crate 110 are received in the recesses 122 of an upper crate 110 nested therein. This provides a very stable nested stack of crates 110. The base 112 of the upper crate 110 is received between the side walls 114 of the crate 110 to reduce stacking height. The flat areas 126 of the crates 110 align in the stack.

Figure 9:
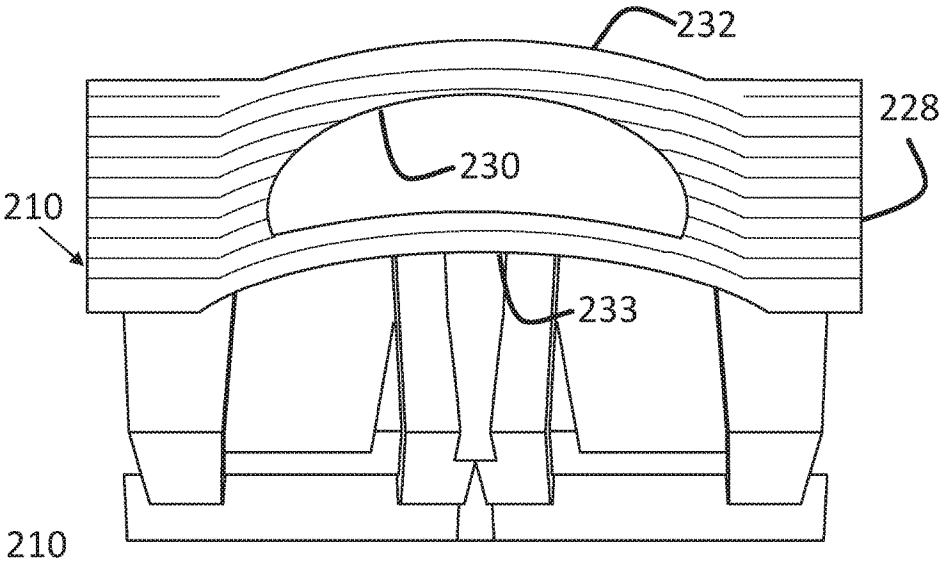
FIG. 9 is an end view of a crate according to a third embodiment.
Figure 10:
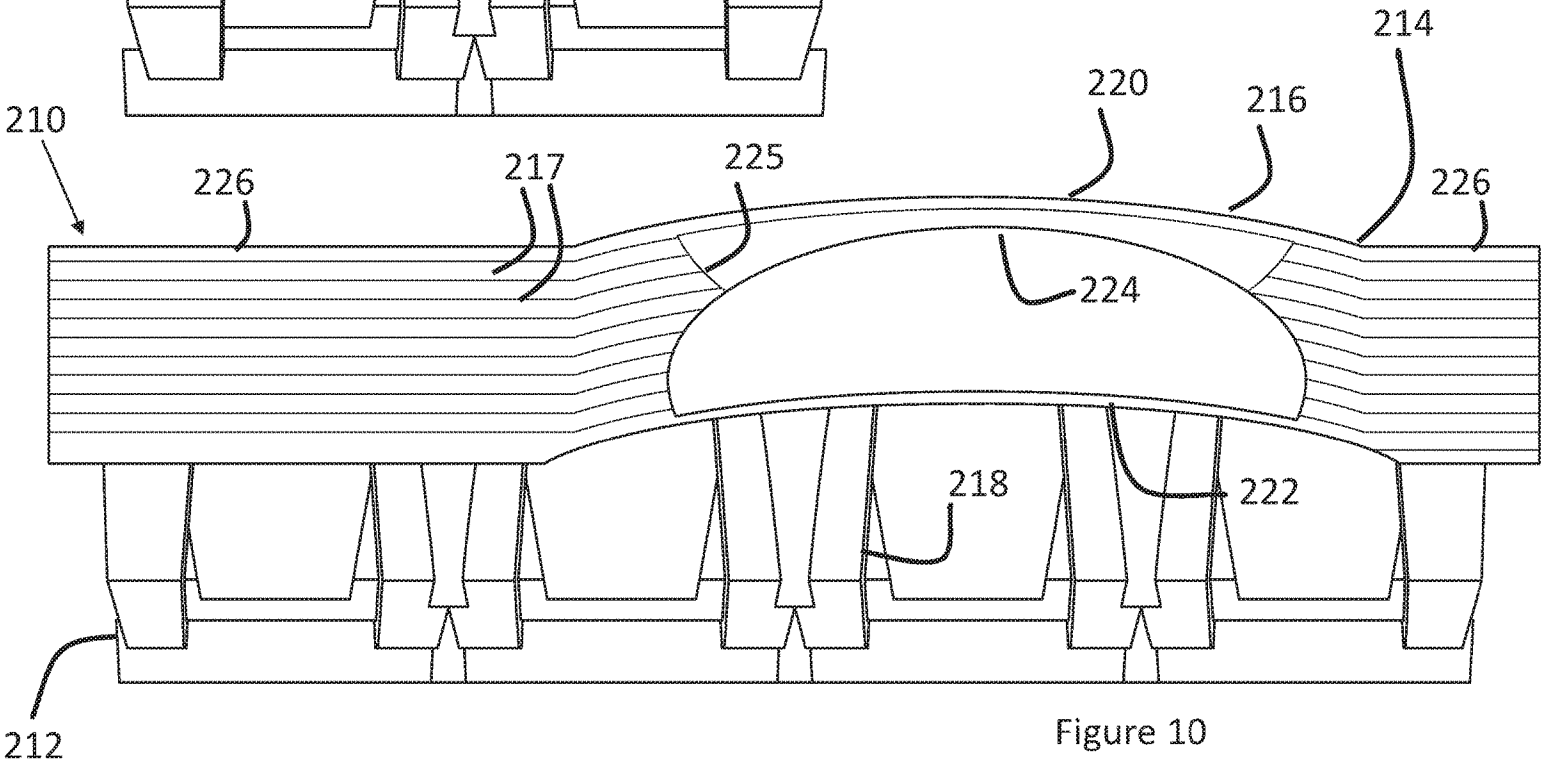
FIG. 10 is a side view of the crate of FIG. 9.

A third crate 210 is shown in FIGS. 9-13. Referring to FIGS. 9-10, the crate 210 includes a base 212 with side walls 214 and end walls 228 extending upward from the base 212. Handle openings 230 are formed in the end walls 228. The end walls 228 include a band portion connected to the base 212 by inwardly-offset columns. The band portion has upper and lower edges that rise and fall together to form a peak 232 on the upper edge and a corresponding recess 233 on the lower edge.

The side walls 214 include a band portion 216 connected to the base 212 by inwardly-offset columns 218. As shown, the band portion 216 of the side wall 214 is asymmetrical and has upper and lower edges that rise and fall together to form an off-center peak 220 extending upward at the upper edge and a recess 222 formed on the lower edge of the band portion 216. A partial upper logo 224 may be molded into the exterior surface of the band portion 216 above the recess 222 and below a partial lower logo 225 below the peak 220. Lines 217 parallel to the upper and lower edges of the band portion 216 are molded into the exterior surface of the band portion 216.

The band portion 216 may also include flat areas 226 adjacent ends of the crate 210 on either side of the peak 220. The upper and lower edge of the band portion 216 are generally horizontal and flat in the flat areas 226. The crate 210 is injection molded as a single piece of suitable plastic.

Figures 11, 12:
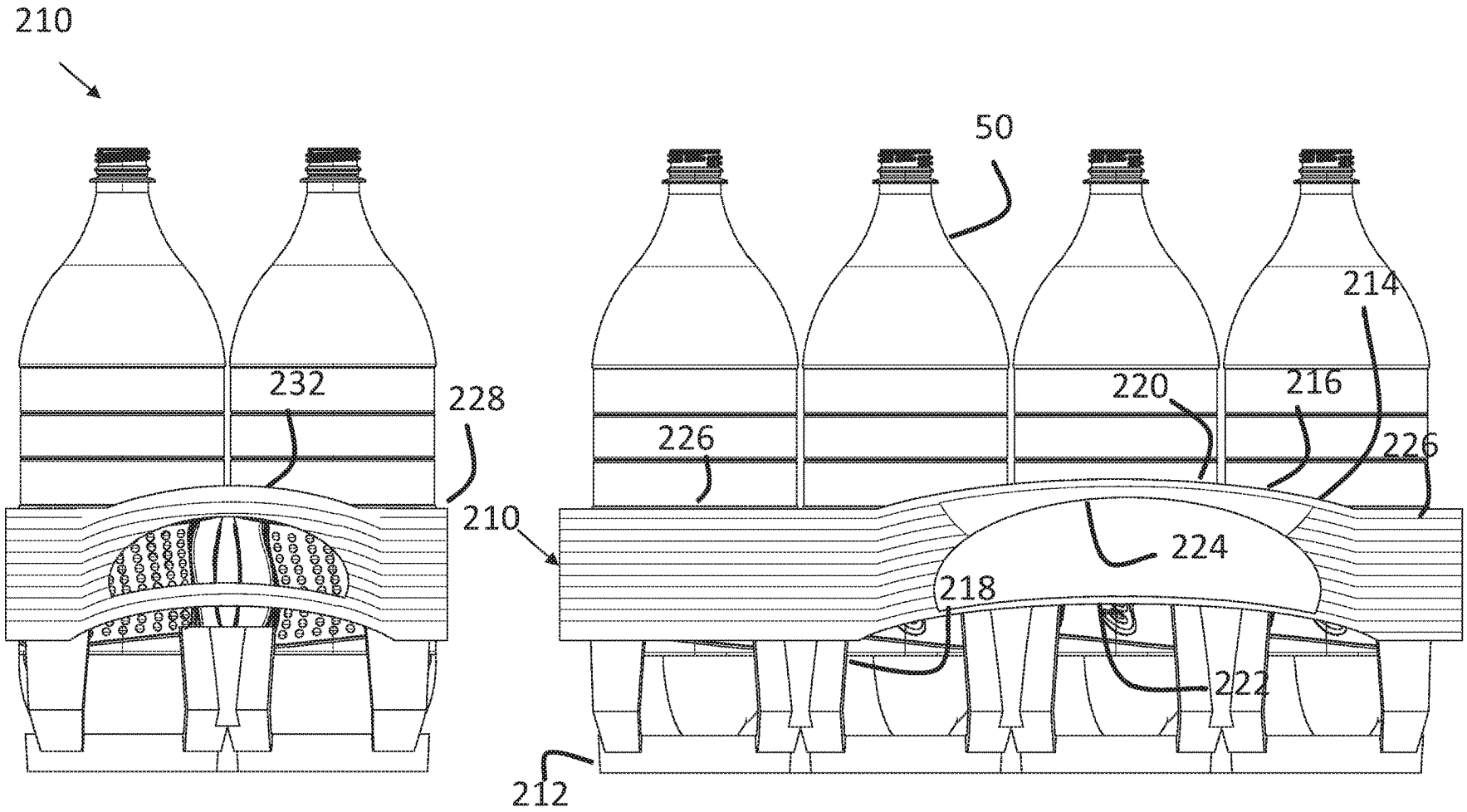
FIG. 11 is an end view of the crate of FIG. 9, loaded with bottles.
FIG. 12 is a side view of the crate and bottles of FIG. 11.

FIGS. 11 and 12 show the crate 210 with a plurality of large multi-serving bottles 50 stored therein, in this example 1.75 L plastic bottles. The peaks 220, 232 align with one or more of the bottles 50 to improve stability. The recess 222 in the bottom edge of the band portion 216 aligns with the label on the bottle 50 to increase label visibility.

Figure 13:
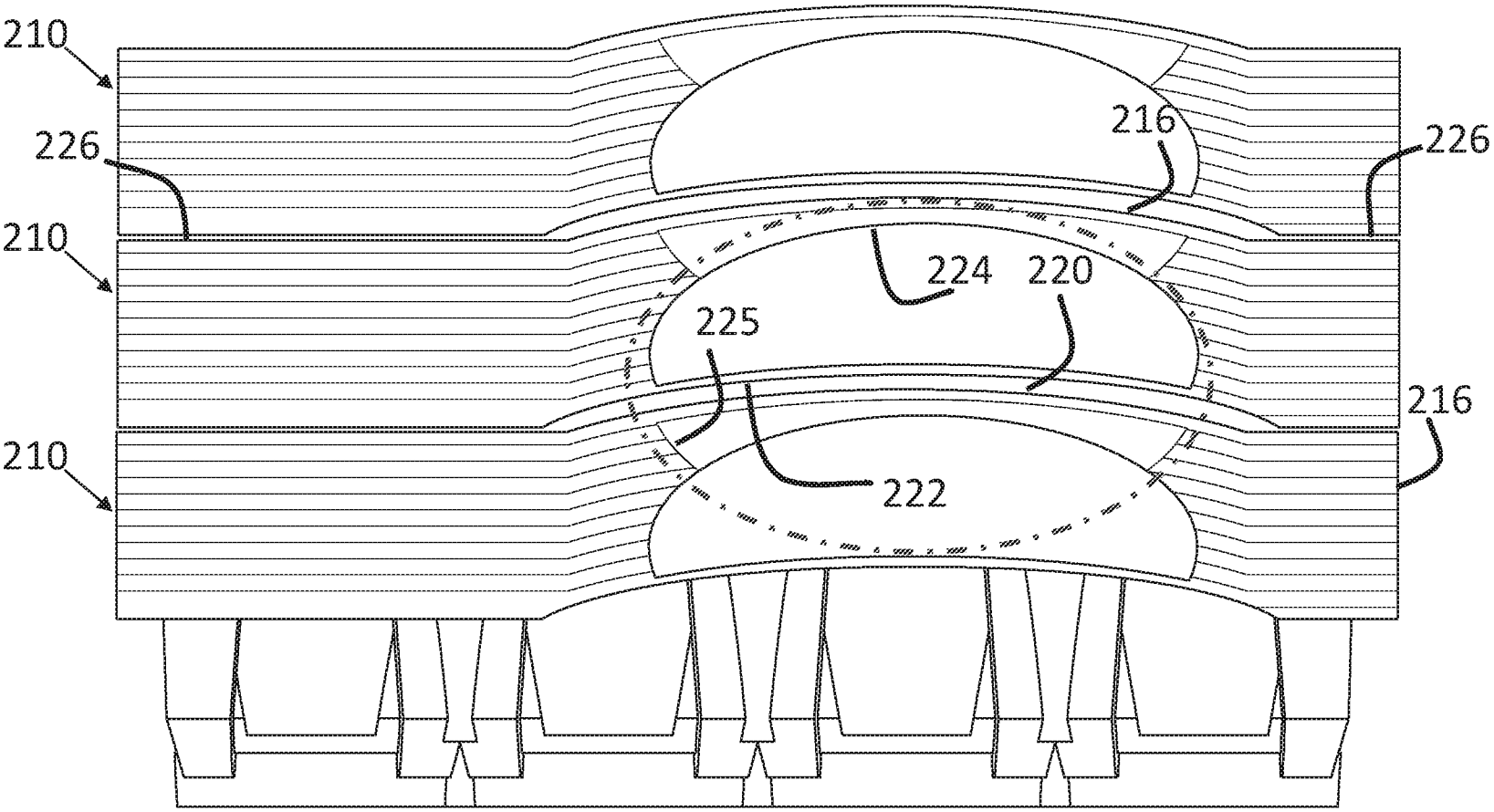
FIG. 13 is a side view of three empty crates of FIG. 9 nested together.

As shown in FIG. 13, the peaks 220 of a lower crate 210 are received in the recesses 222 of an upper crate 210 nested therein. This provides a very stable nested stack of crates 210. The base 212 of the upper crate 210 is received between the side walls 214 of the crate 210 to reduce stacking height. The flat areas 226 of the crates 210 align in the stack. The partial lower logo 225 of a lower crate 210 aligns with the partial upper logo 224 of an upper crate 210 nested therein. The partial logos align to form a complete logo when in a stack of nested crates 210.

Figure 14:
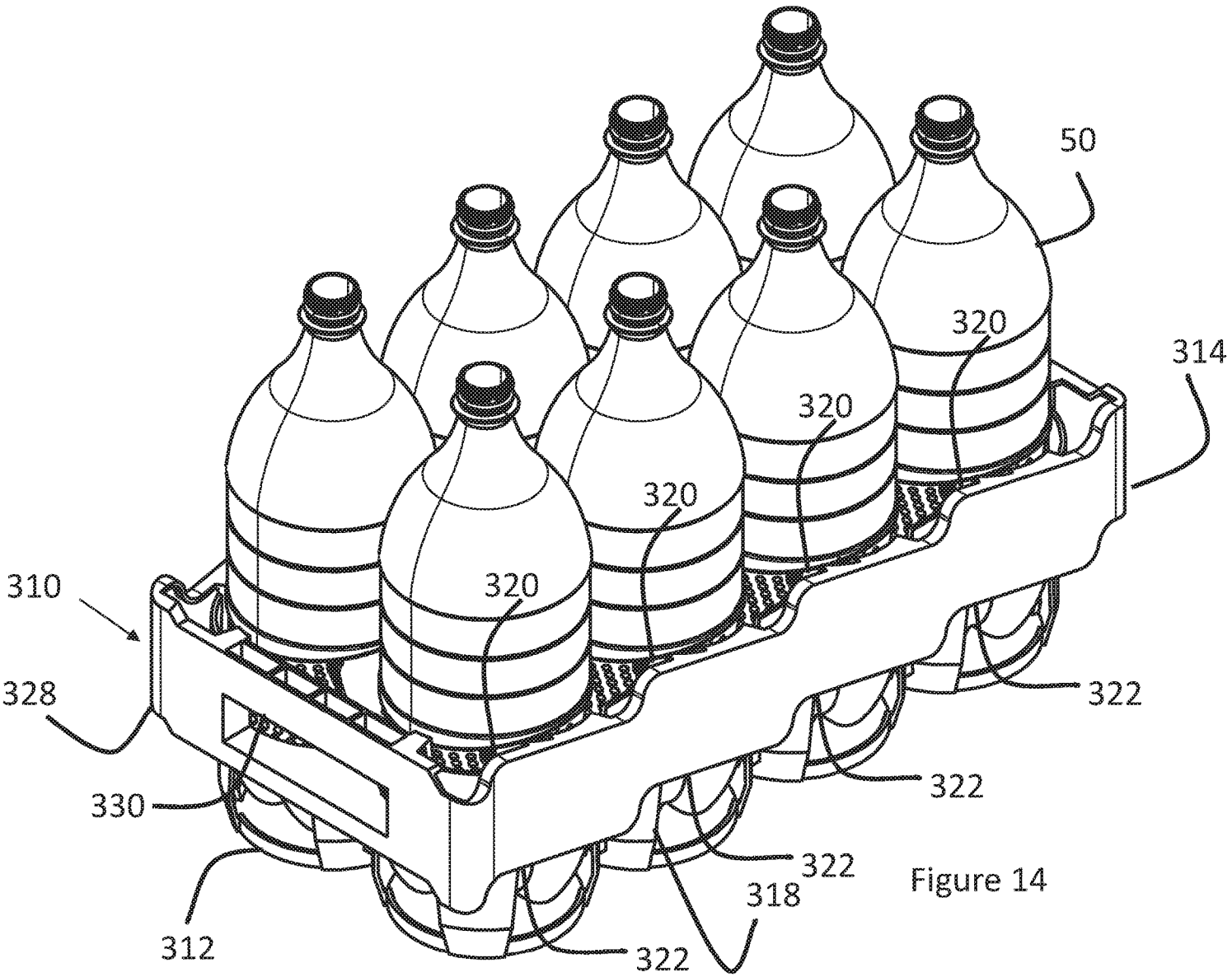
FIG. 14 is a perspective view of a crate according to a fourth embodiment, loaded with bottles.
Figures 15, 16:
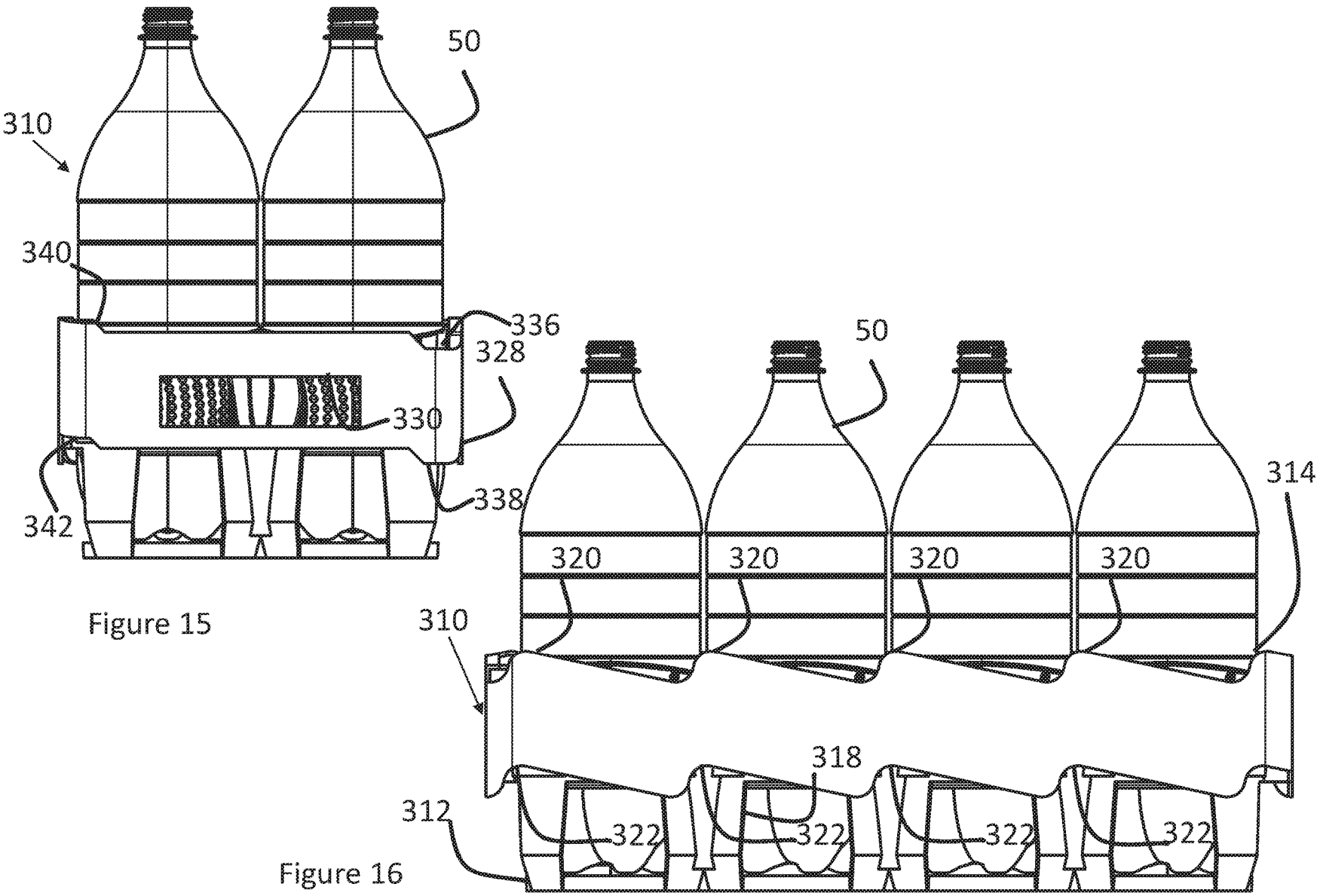
FIG. 15 is an end view of the crate and bottles of FIG. 14.
FIG. 16 is a side view of the crate and bottles of FIG. 14.

A fourth crate 310 is shown in FIGS. 14-16 with the bottles 50 loaded therein. The crate 310 includes a base 312 with side walls 314 and end walls 328 extending upward from the base 312. Handle openings 330 are formed in the end walls 328. The end walls 328 include a band portion connected to the base 312 by inwardly-offset columns.

The side walls 314 include a band portion 316 connected to the base 312 by inwardly-offset columns 318. As shown, the band portion 316 of the side wall 314 is asymmetrical and has upper and lower edges that rise and fall together to form a plurality of peaks 320 extending upward at the upper edge and corresponding recesses 322 formed on the lower edge of the band portion 316. The peaks 320 and recesses 322 are regular and repeating adjacent each bottle 50. In this example, the upper and lower edges follow a reverse saw-tooth wave pattern, with rounded edges. The band portion 316 of the opposite side wall 314 is preferably identical (but alternatively could be mirror image). This embodiment captures every bottle at the same height and width consistently while maintaining a 180 degree asymmetrical design. The asymmetrical contoured band design effectively creates an extended band height without increasing the height of the nest. The extended height paired with the asymmetry prevents side by side "shingling" that occurs when similar height bands catch/interfere on top of each other. The crate 310 is injection molded as a single piece of suitable plastic.

FIGS. 15 and 16 show the crate 310 and the large multi-serving bottles 50. Each of the four peaks 320 on each side wall 14 aligns with one of the bottles 50 to improve stability. When nested, the peaks 320 of a lower crate 310 would be received in the recesses 322 of an upper crate 310 nested therein.

Figure 17:
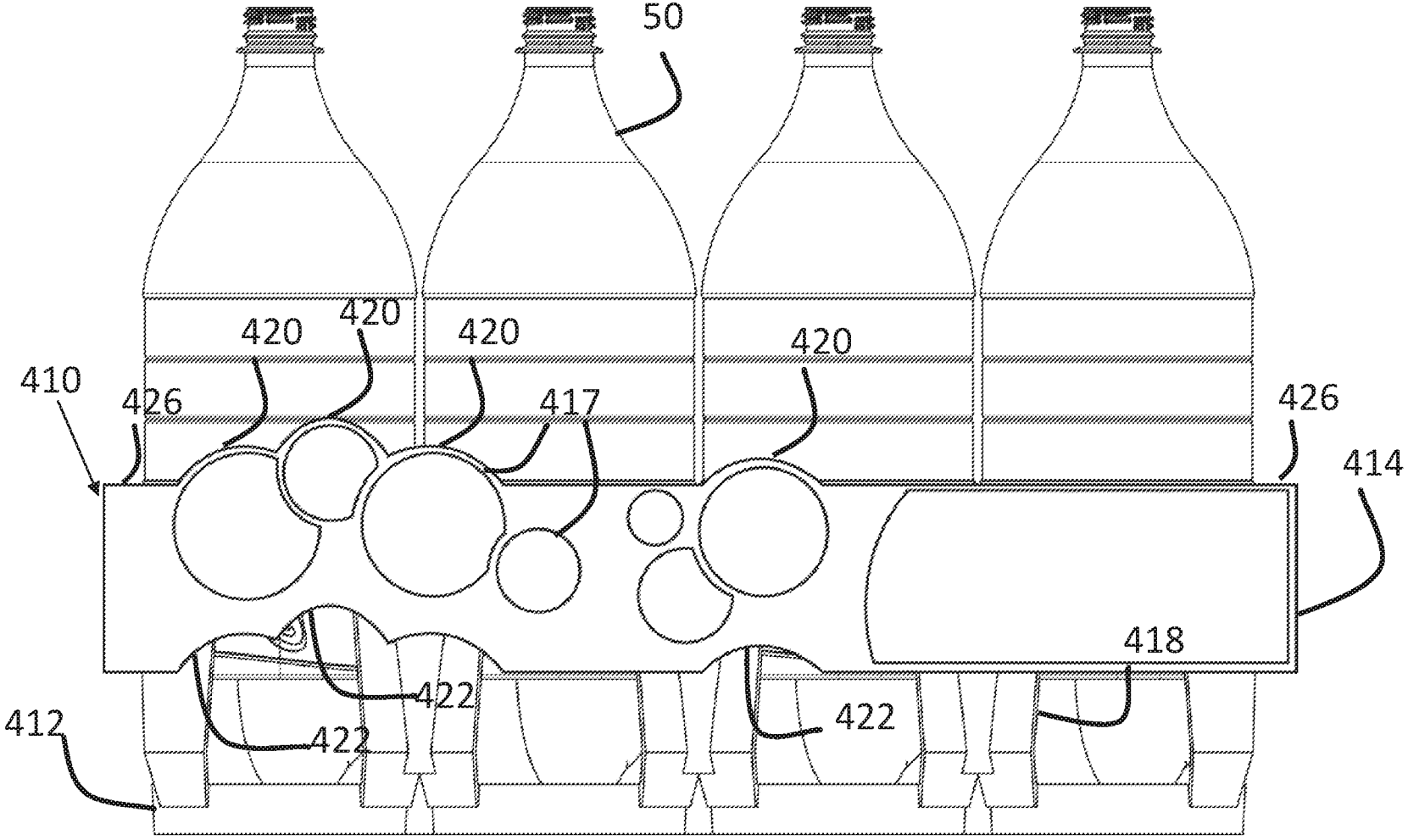
FIG. 17 is a side view of a crate according to a fifth embodiment, loaded with bottles.
Figure 18:
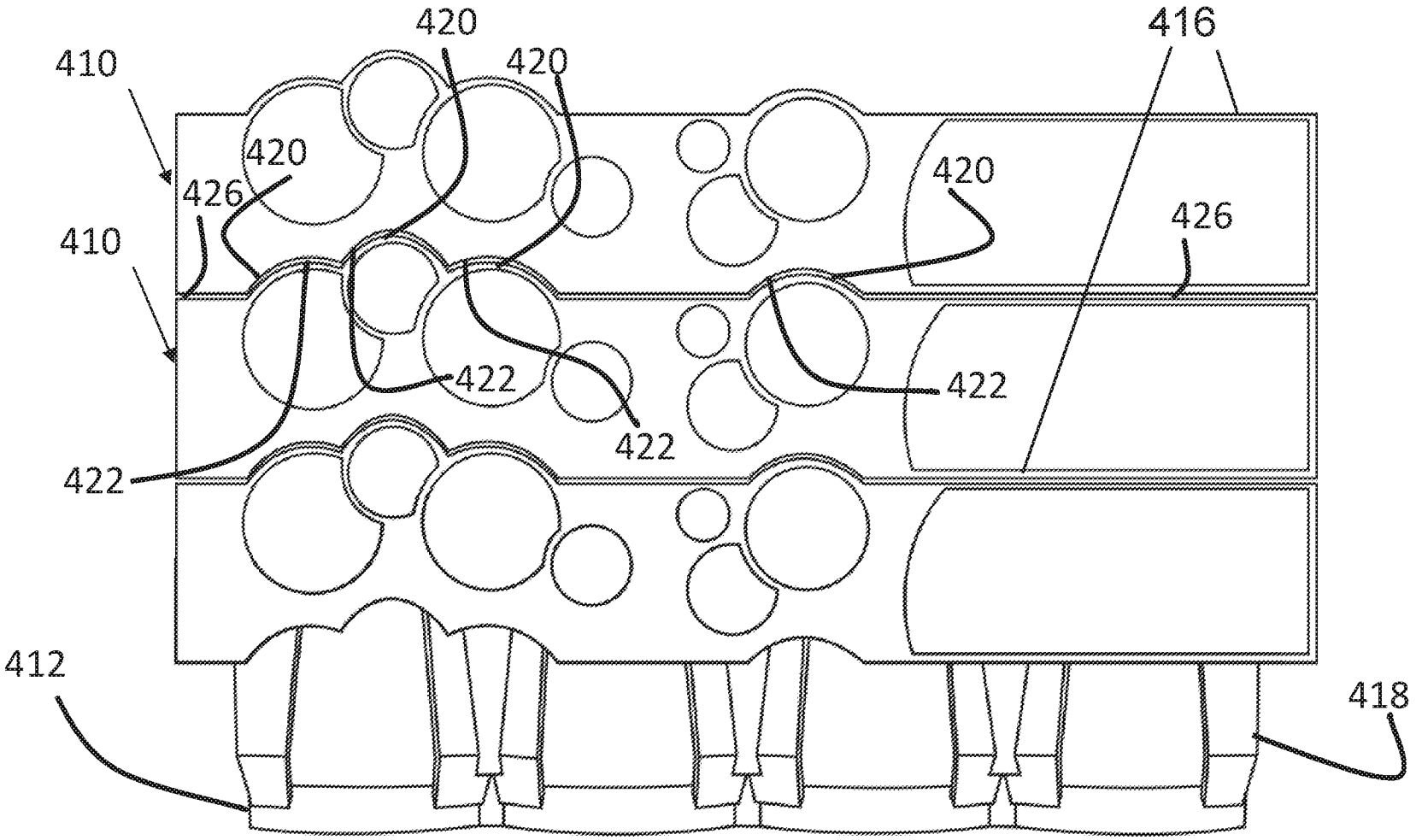
FIG. 18 is a side view of three empty crates of FIG. 17, nested together.

A fifth crate 410 is shown in FIGS. 17-18. The crate 410 is shown in FIG. 17 with the bottles 50 loaded therein. The crate 410 includes a base 412 with side walls 414 and end walls 428 extending upward from the base 412. The side walls 414 include a band portion 416 connected to the base 412 by inwardly-offset columns 418. As shown, the band portion 416 of the side wall 414 is asymmetrical and has upper and lower edges that rise and fall together to form a plurality of peaks 420 extending upward at the upper edge and corresponding recesses 422 formed at the lower edge of the band portion 416. The peaks 420 are each formed as a portion of a circle design 417 molded into the exterior surface of the band portion 416 to form an image of a bubble, which is suggestive of the contents of the bottles 50. The peaks 420 and recesses 422 are formed asymmetrically in the band portion 416. The other side wall 414 would be identical (but alternatively a mirror image). The crate 410 is injection molded as a single piece of suitable plastic.

As shown in FIG. 18, the peaks 420 of a lower crate 410 are received in the recesses 422 of an upper crate 410 nested therein. This provides a very stable nested stack of crates 410. The base 412 of the upper crate 410 is received between the side walls 414 of the crate 410 to reduce stacking height. The flat areas 426 of the crates 410 align in the stack. The peaks 420 also reduce the incidence of shingling because they increase the effective height of the band portions 416.

Figure 19:
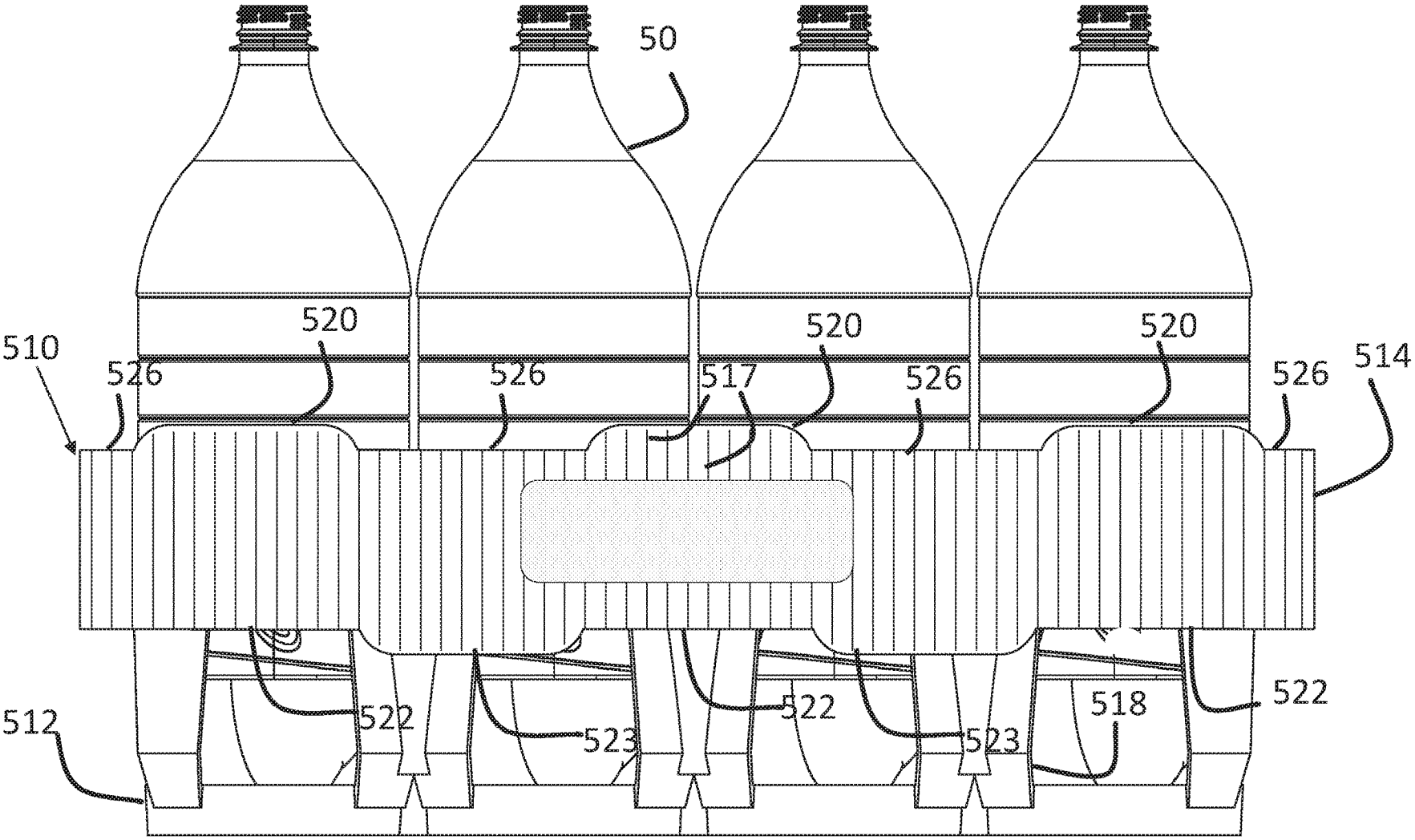
FIG. 19 is a side view of a crate according to a sixth embodiment, loaded with bottles.

A sixth crate 510 is shown in FIG. 19 with the bottles 50 loaded therein. The crate 510 includes a base 512 with side walls 514 and end walls 528 extending upward from the base 512. The side walls 514 include a band portion 516 connected to the base 512 by inwardly-offset columns 518. As shown, the band portion 516 of the side wall 514 is symmetrical and has upper and lower edges that rise and fall together to form a plurality of peaks 520 extending upward at the upper edge and corresponding recesses 522 formed on the lower edge of the band portion 516. The peaks 520 and recesses 522 are formed symmetrically in the band portion 516. The opposite side wall 414 may be identical (or the peaks may be switched for recesses and vice versa). The crate 510 is injection molded as a single piece of suitable plastic.

As is not shown, the peaks 520 of a lower crate 510 would be received in the recesses 522 of an upper crate 510 nested therein. This provides a very stable nested stack of crates 510. The base 512 of the upper crate 510 is received between the side walls 514 of the crate 510 to reduce stacking height. The flat areas 526 of the crates 510 align in the stack. The peaks 520, 523 increase the effective height of the side band portion 516 without increasing the nesting height.

Figure 20:
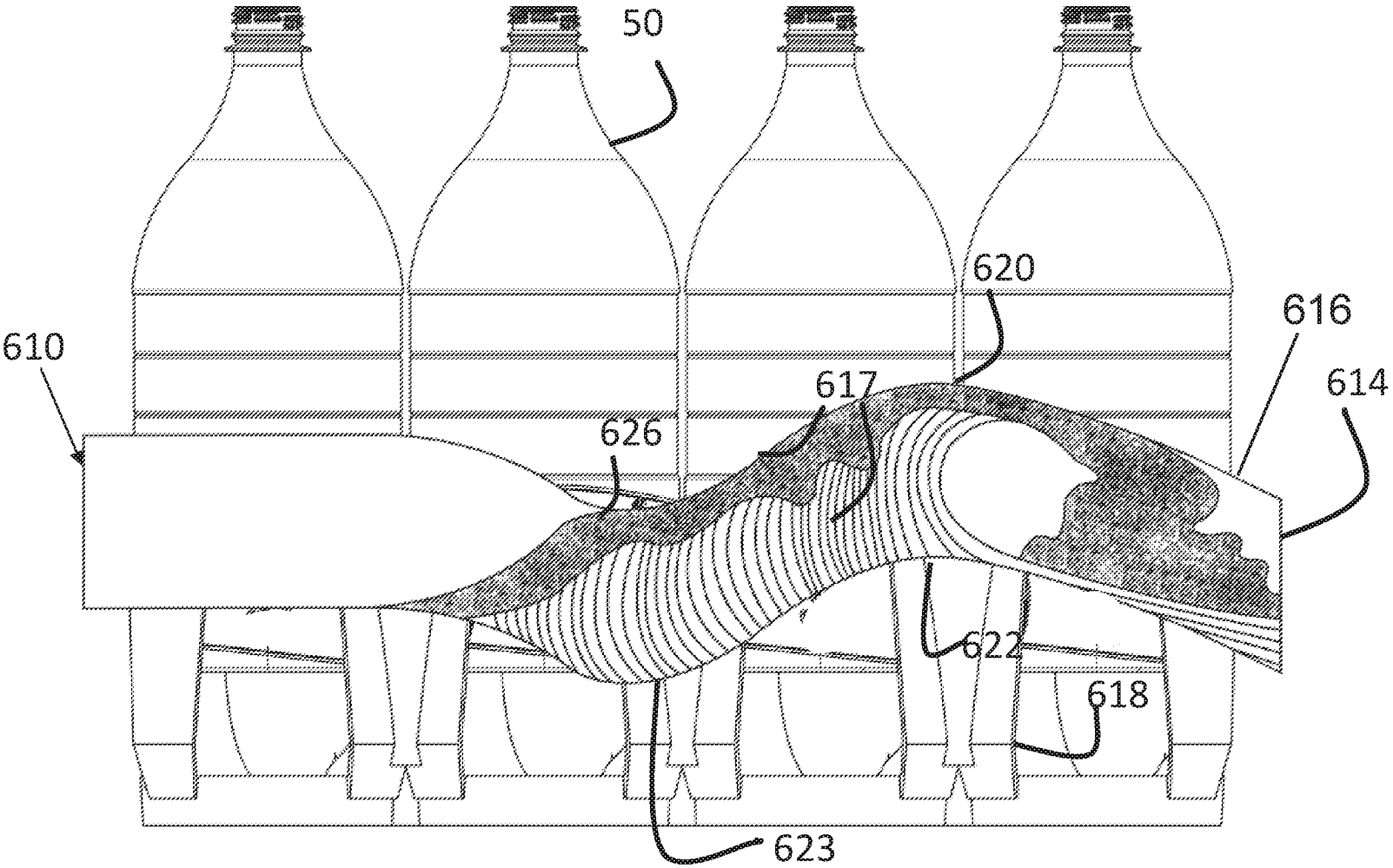
FIG. 20 is a side view of a crate according to a seventh embodiment, loaded with bottles.
Figure 21:
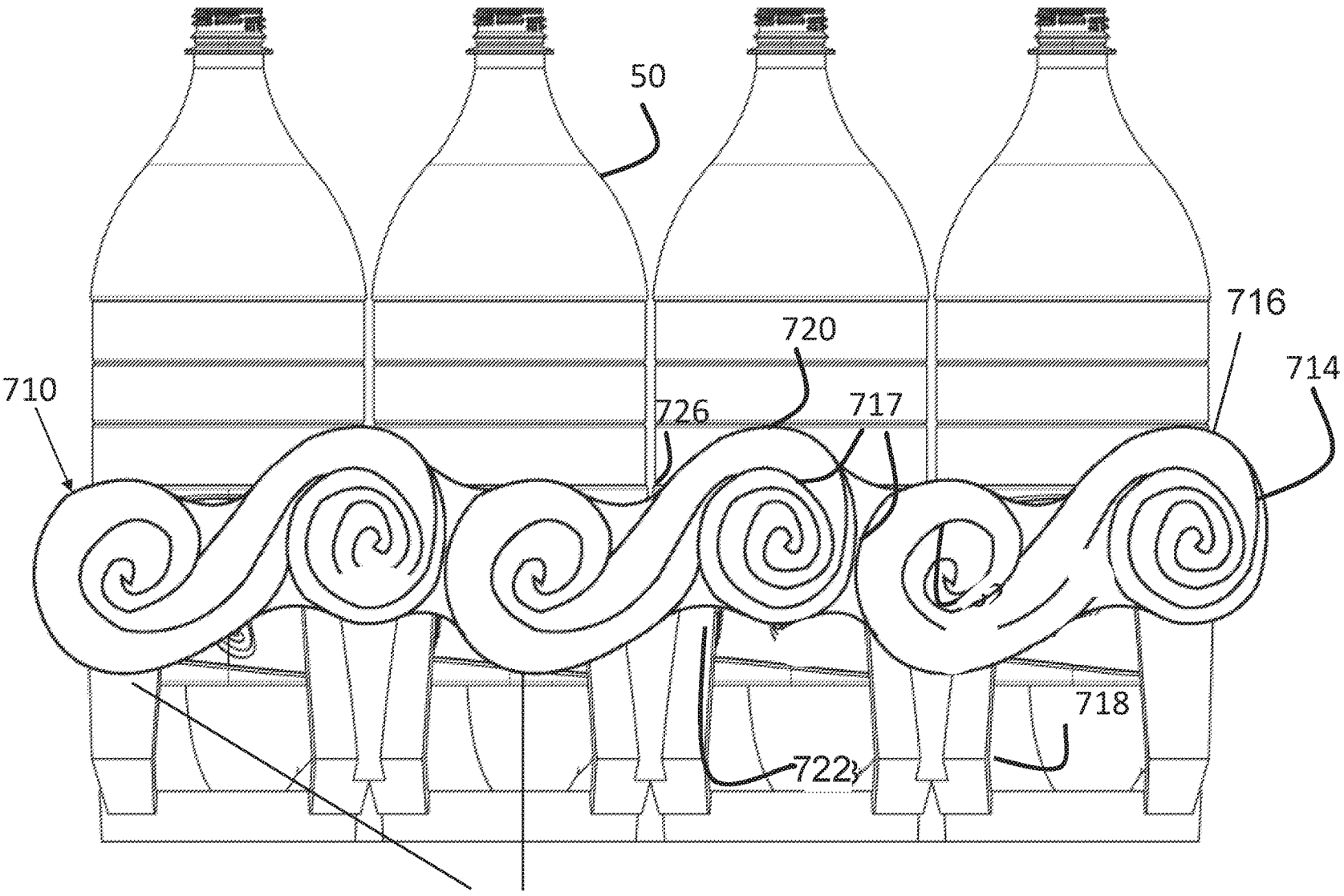
FIG. 21 is a side view of a crate according to an eighth embodiment, loaded with bottles.

A seventh crate 610 is shown in FIG. 20 with the bottles 50 loaded therein. The crate 610 includes a base 612 with side walls 614 and end walls extending upward from the base 612. The side walls 614 include a band portion 616 connected to the base 612 by inwardly-offset columns 618. As shown, the band portion 616 of the side wall 614 is asymmetrical and has upper and lower edges that rise and fall together to form a peak 620 extending upward at the upper edge and corresponding recesses 622 formed on the lower edge of the band portion 616. A lower peak 623 projects downward from the band portion 616 and has a corresponding recess 626 at the upper edge of the band portion 616, above the lower peak 623. The peaks 620, 623 and recesses 622, 626 are formed asymmetrically in the band portion 616. Design lines 617 may be molded into the exterior surface of the band portion 616. The design lines 617 may hide sink lines in the surface of the band portion 616. The other side wall 614 is preferably identical (or alternatively mirror image). The crate 610 is injection molded as a single piece of suitable plastic.

As is not shown, the peaks 620 of a lower crate 610 would be received in the recesses 622 of an upper crate 610 nested therein. This provides a very stable nested stack of crates 610. The base 612 of the upper crate 610 is received between the side walls 614 of the crate 610 to reduce stacking height. The flat areas of the crates 610 align in the stack. The peaks 620, 623 also increase the effective height of the band portion 616, thereby reducing shingling, while the recesses 622, 626 prevent the peaks 620, 623 from increasing the nesting height.

An eighth crate 710 is shown in FIG. 20 with the bottles 50 loaded therein. The crate 710 includes a base 712 with side walls 714 and end walls extending upward from the base 712. The side walls 714 include a band portion 716 connected to the base 712 by inwardly-offset columns 718. As shown, the band portion 716 of the side wall 714 is asymmetrical and has upper and lower edges that rise and fall together to form a plurality of peaks 720 extending upward at the upper edge and corresponding recesses 722 formed on the lower edge of the band portion 716. Peaks 723 are formed at the lower edge of the band portion 716, with complementary recesses at the upper edge of the band portion 716. The peaks 720 and recesses 722 are formed asymmetrically in the band portion 716. Design lines 717, such as swirls, may be molded into the exterior surface of the band portion 716 to coincide with the peaks 720. The design lines 717 may hide sink lines in the surface of the band portion 716. The crate 710 is injection molded as a single piece of suitable plastic.

As is not shown, the peaks 720 of a lower crate 710 would be received in the recesses 722 of an upper crate 710 nested therein. This provides a very stable nested stack of crates 710. The base 712 of the upper crate 710 is received between the side walls 714 of the crate 710 to reduce stacking height. The flat areas of the crates 710 align in the stack. The upward and downward peaks also increase the effective height of the band portion 716, thereby reducing shingling without increasing nesting height.

Figure 22:
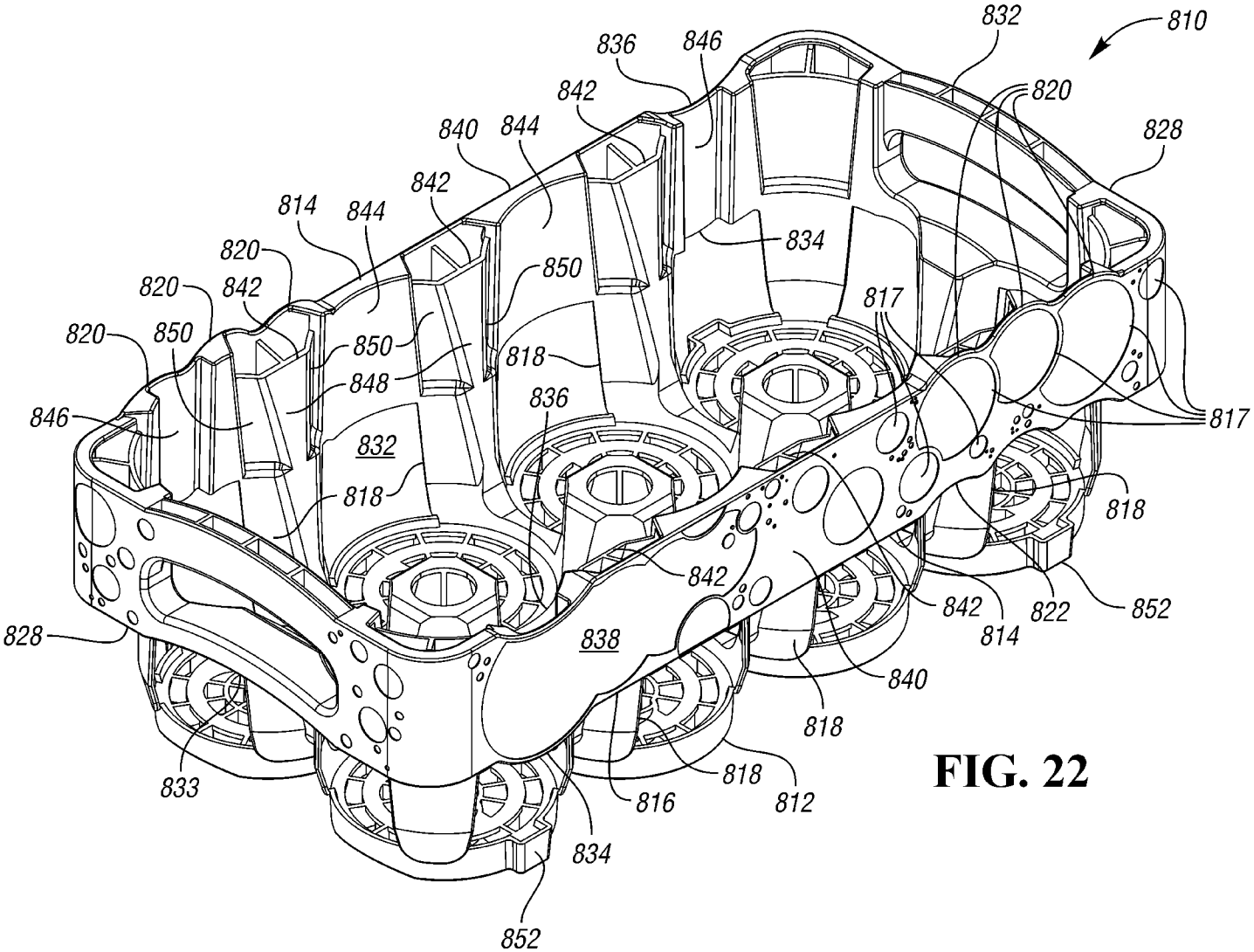
FIG. 22 is a perspective view of a crate according to a ninth embodiment.

A ninth crate 810 is shown in FIGS. 22-30. Referring to FIG. 22, the crate 810 includes a base 812 with side walls 814 and end walls 828 extending upward from the base 812. Interior columns partially define a plurality of bottle-receiving pockets. In this example, three interior columns partially define eight bottle-receiving pockets. The side walls 814 include a band portion 816 connected to the base 812 by inwardly-offset columns 818. As shown, the band portion 816 of the side wall 814 is asymmetrical (left to right) and has upper and lower edges that rise and fall together to form a plurality of peaks 820 extending upward at the upper edge and corresponding recesses 822 formed on the lower edge of the band portion 816. The upper edge of the band portion 816 on each side wall is complementary to the lower edge. The lower edge of the band portion 816 also includes a lower peak 834 extending downward. A complementary recess 836 is formed in the upper edge of the band portion 816 above the peak 834. A logo field 838 is formed in the band portion 816 as part of the peak 834 and recess 836.

The peaks 820 are each formed as a portion of a circle design 817 molded into the exterior surface of the band portion 816 to form an image of a bubble, which is suggestive of the contents of the bottles to be carried in the crate 810. Other circle designs 817 are also formed in the exterior surface of the band portion 816. The peaks 820, 834 and recesses 822, 836 are formed asymmetrically in the band portion 816. The two side walls 814 may be identical, as shown (or alternatively, mirror image). The upward and downward peaks 820, 834 increase the effective height of the band portion 816, thereby reducing shingling without increasing nesting height. The crate 810 is injection molded as a single piece of suitable plastic.

The upper band portion 816 includes an outer wall portion 840 in which the circle designs 817 and the logo field 838 are formed. The peaks 820, 834 and recesses 822, 836 are all formed in the outer wall portion 840. The upper band portion 816 includes a plurality of upper dividers 842 aligned above each column 818.

Between three of the upper dividers 842 in each side wall 814 are two concave inner wall portions 844 which would align with two of the bottle receiving areas. The inner wall portions 844 are spaced inward of the outer wall portion 840 defining a cavity therebetween and forming a double-walled portion. Outward of the three upper dividers 842 (between the upper divider 842 and the corner of the crate 810) is a pair of upper recesses 846 which define a single-walled portion (i.e. only the outer wall portion 840 separates the exterior from the interior of the crate 810).

Each upper divider 842 includes an angled inner wall portion 848 and a pair of angled side walls 850. The angled side walls 850 extend outward toward the exterior of the crate 10 further than the adjacent edge of the concave inner wall portion 844, to create a jut or ridge at the juncture.

The base 812 includes at least one (and may include a plurality, as shown) of lugs or projections 852, projecting toward the exterior of the crate 810 generally in the plane of the base 812. The projections 852 are aligned with the upper recesses 846.

The end walls 828 also include a band portion connected to the base 812 by inwardly-offset columns. The band portion has upper and lower edges that rise and fall together to form a peak 832 on the upper edge and a corresponding recess 833 on the lower edge. The peak 832 is convex about an axis generally parallel to the long axis of the crate 810. The arched end wall 828 accommodates the contoured handle (more comfortable), provides some interlock between the end walls 828 of nested crates 810 and provides an anti-theft feature. With the arched end walls 828, the crate 810 will be unstable if flipped upside-down. This inhibits use as a platform or support and discourages theft.

Figure 24:
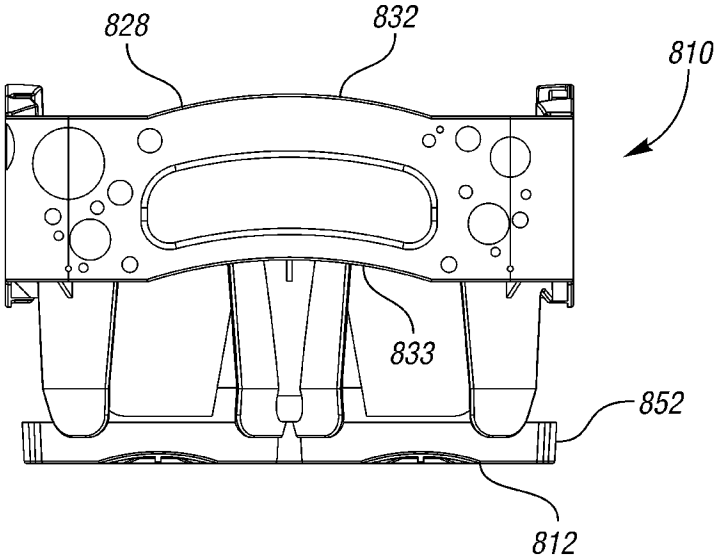
FIG. 24 is an end view of the crate of FIG. 23.
Figure 23:
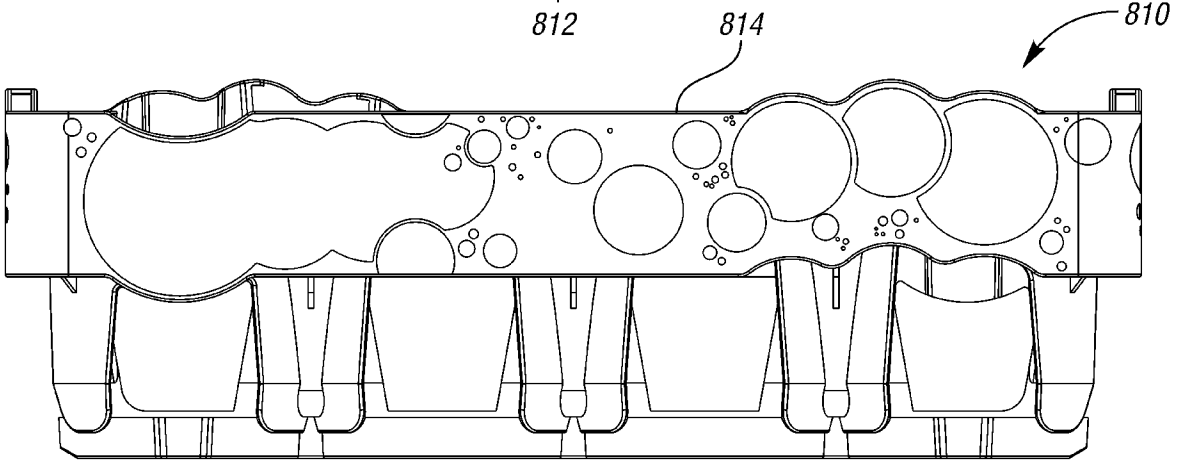
FIG. 23 is a side view of the crate of FIG. 22.

FIG. 23 is a side view of the crate 810, showing that the opposite side walls 814 are identical (not mirror image in this example). FIG. 24 is an end view of the crate 810. The projections 852 project outward less than the band portions 816 of the side walls 814.

Figure 25:
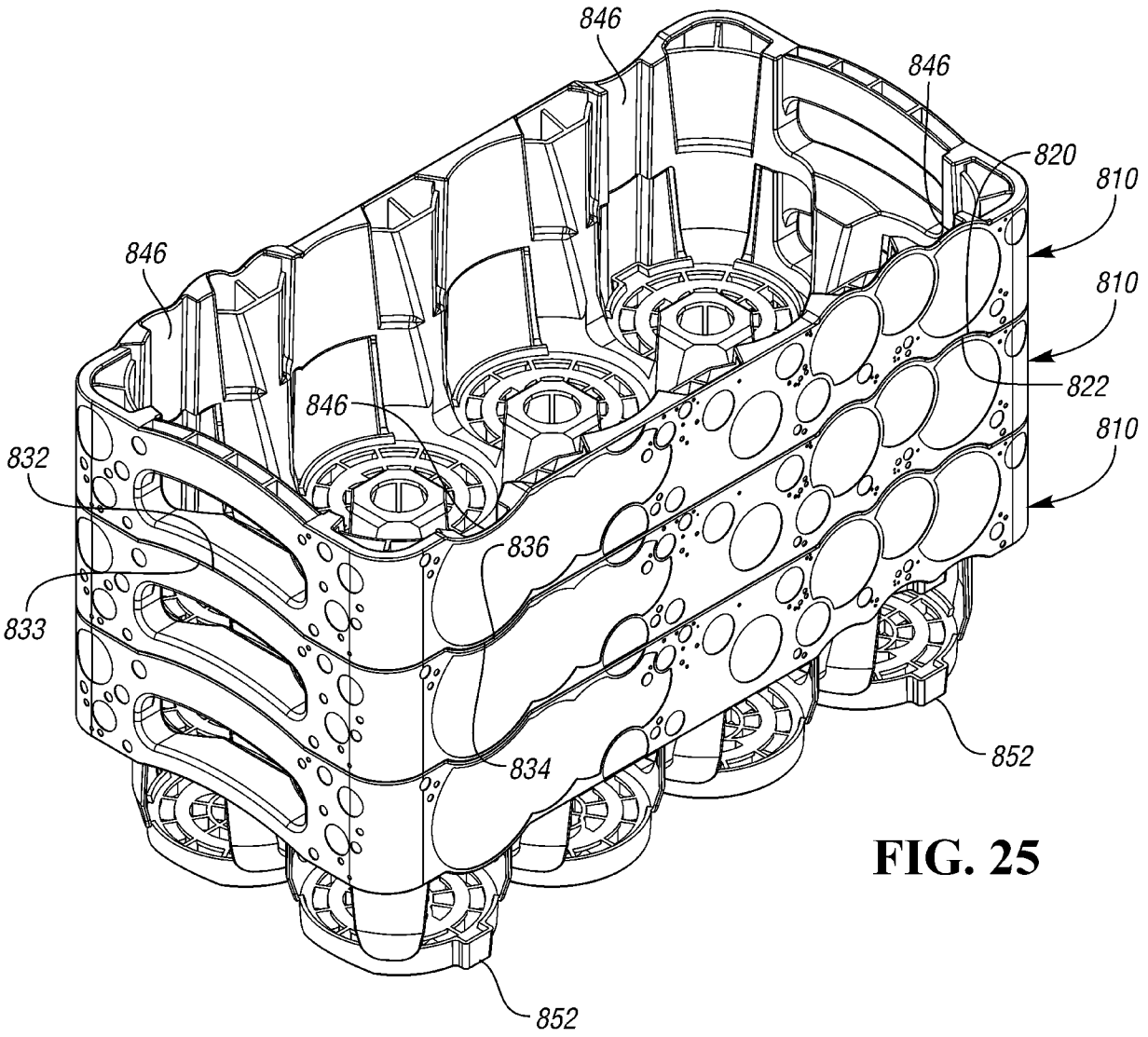
FIG. 25 is a perspective view of three of the crates of FIG. 22 nested together.

FIG. 25 shows three of the crates 810 empty and nested within one another. As shown, the peaks 820 on the upper edge of the band portion 816 are received in the recesses 822 on the lower edge of the band portion 816 of the crate 810 above. The peak 834 on the lower edge of the band portion 816 is received in the recess 836 in the upper edge of the band portion 816 on the crate 810 below. On the end walls 828, the peaks 832 are received in the recesses 833 of the crate 810 above. Although not visible, the projections 852 in the base 812 of each crate 810 are received in the upper recesses 846 of the crate 810 below.

Figure 26:
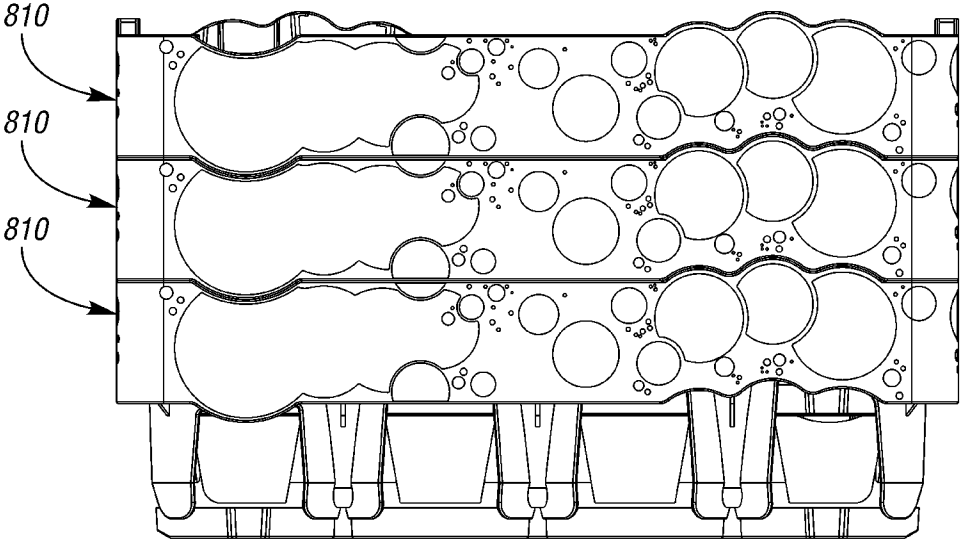
FIG. 26 is a side view of the crates of FIG. 25.
Figure 27:
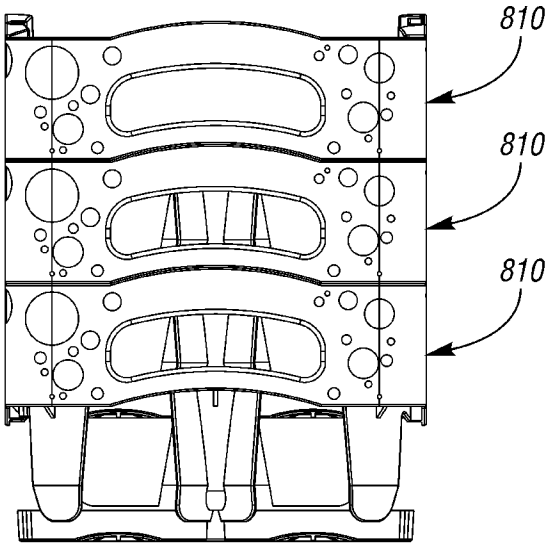
FIG. 27 is an end view of the crates of FIG. 25.

FIGS. 26 and 27 are side and end views, respectively, of the crates 810 of FIG. 25.

Figure 28:
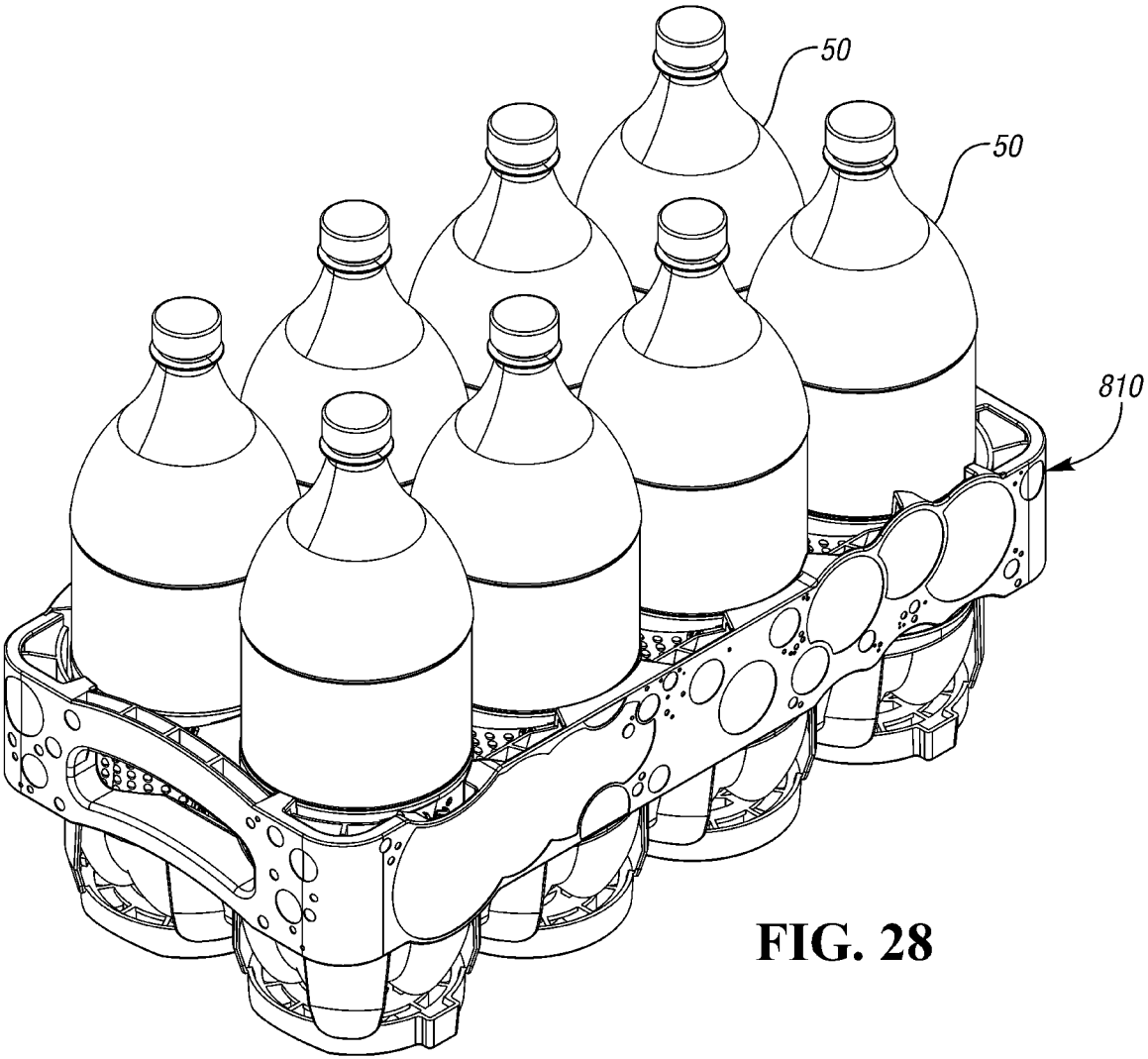
FIG. 28 is a perspective view of the crate of FIG. 22, loaded with bottles.
Figure 29:
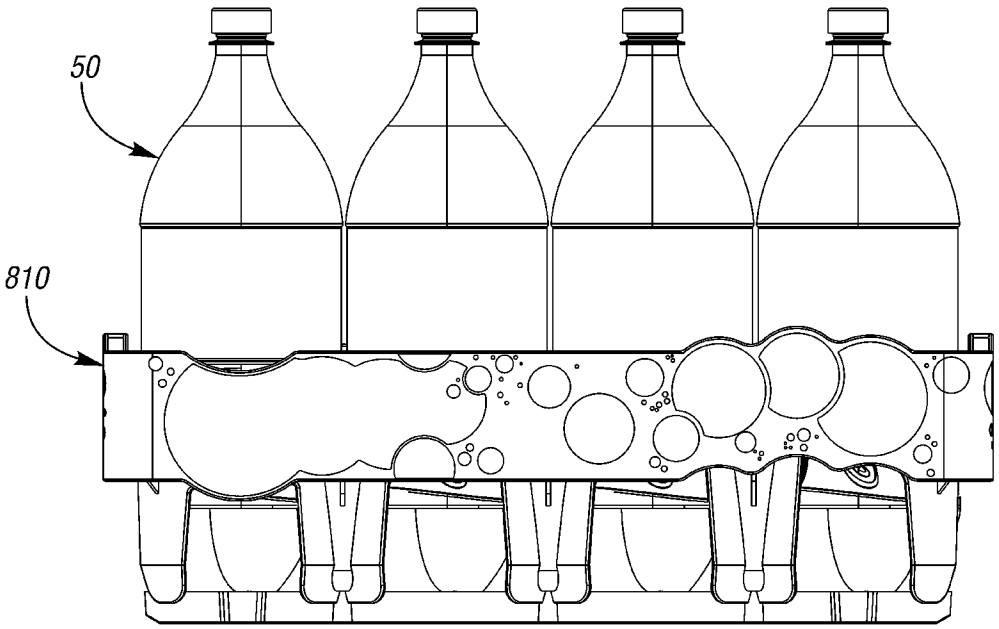
FIG. 29 is a side view of the crate and bottles of FIG. 28.
Figure 30:
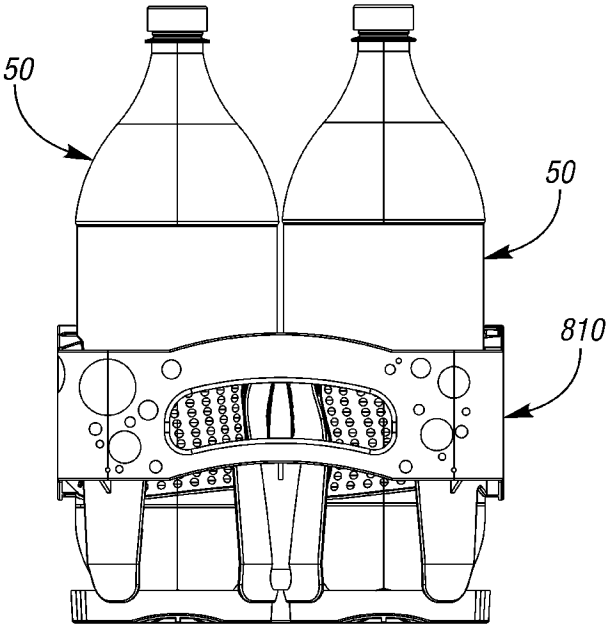
FIG. 30 is an end view of the crate and bottles of FIG. 28.

FIG. 28 shows the crate 810 of FIG. 22 with a plurality (in this example, eight) of the bottles 50 (again, 1.75 L bottles 50 in this example) received therein. FIGS. 29 and 30 are side and end views, respectively, of the crate 810 and bottles 50 of FIG. 28. The interior structure of the crates of the first eight embodiments could be identical to that of the ninth embodiment crate 810 of FIGS. 22-30.

Figure 31:
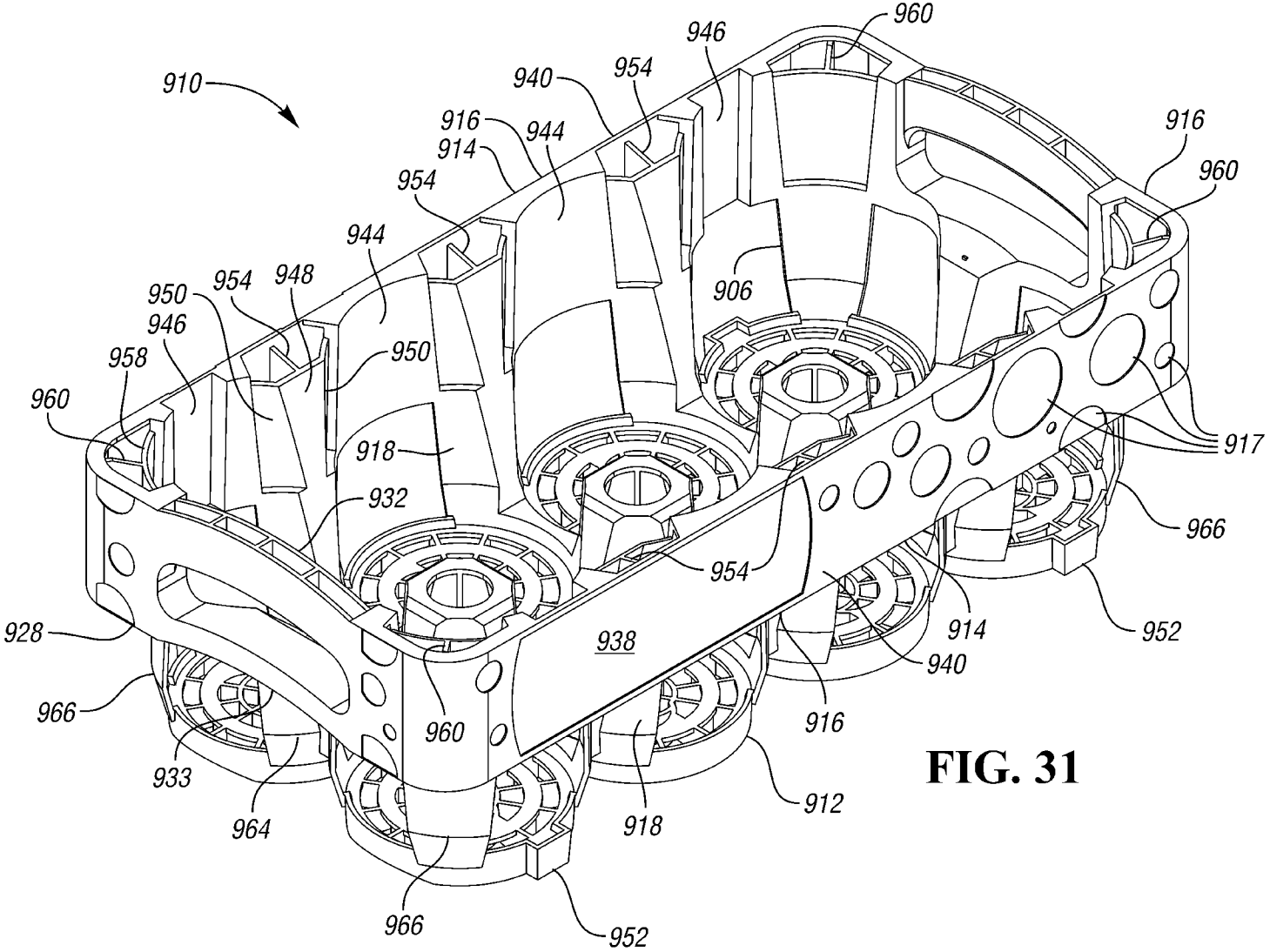
FIG. 31 is a perspective view of a crate according to a tenth embodiment.

A tenth crate 910 is shown in FIG. 31. Referring to FIG. 31, the crate 910 includes a base 912 with side walls 914 and end walls 928 extending upward from the base 912. Interior columns partially define a plurality of bottle-receiving pockets. In this example, three interior columns partially define eight bottle-receiving pockets. The side walls 914 include a band portion 916 connected to the base 912 by inwardly-offset columns 918. The end walls 928 also each include a band portion connected to the base 912 by an inwardly-offset column 964. Corner columns 966 connect the corners of the band portions to the base 912.

In this embodiment, the band portion 916 of the side wall 914 is symmetrical and has straight, flat upper and lower edges. A logo field 938 is formed in the band portion 916.

A plurality of circle designs 917 are molded into the exterior surface of each band portion 916 to form an image of a bubble, which is suggestive of the contents of the bottles to be carried in the crate 910.

The upper band portion 916 includes an outer wall portion 940 in which the circle designs 917 and the logo field 938 are formed. The upper band portion 916 includes a plurality of upper dividers 942 aligned above each column 918.

Between three of the upper dividers 942 in each side wall 914 are two concave inner wall portions 944 which would align with two of the bottle receiving areas. The inner wall portions 944 are spaced inward of the outer wall portion 940 defining a cavity therebetween and forming a double-walled portion. Outward of the three upper dividers 942 (between the upper divider 942 and the corner of the crate 910) is a pair of upper recesses 946, thereby defining a single-walled portion (i.e. only the outer wall portion 940).

Figure 32:
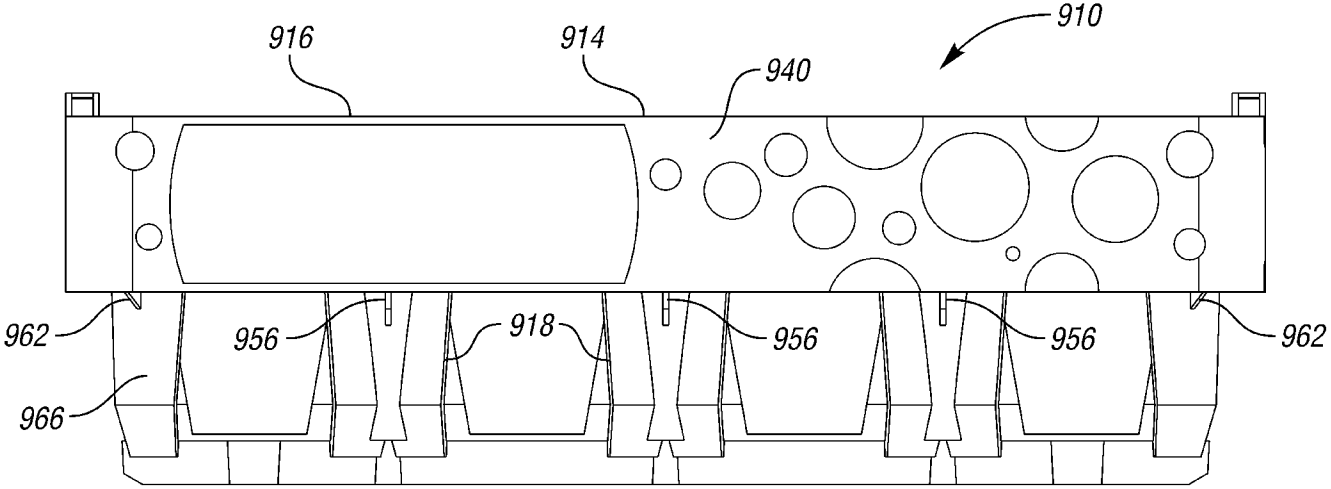
FIG. 32 is a side view of the crate of FIG. 31.

Each upper divider 942 includes an angled inner wall portion 948 and a pair of angled side walls 950. The angled side walls 950 extend outward toward the exterior of the crate 10 further than the adjacent edge of the concave inner wall portion 944, to create a jut or ridge at the juncture. A rib 954 extends from the angled inner wall portion 948 to the outer wall portion 940 of the upper band portion 916. The rib 954 extends down below the upper band portion 916 to form an anti-shingling rib portion 956 (FIG. 32). Inner wall portions 958 (FIG. 31) in each of the corners of the crate 910 also have a rib 958 extending to the outer wall portion 940 and extend down to form an anti-shingling rib portion 962 (FIG. 32).

Referring again to FIG. 31, the base 912 includes at least one (and may include a plurality, as shown) of lugs or projections 952, projecting toward the exterior of the crate 910 generally in the plane of the base 912. The projections 952 are aligned with the upper recesses 946.

The end walls 928 also include a band portion connected to the base 912 by inwardly-offset columns 964. The band portion has upper and lower edges that rise and fall together such that the upper edge forms a peak 932 and the lower edge forms a corresponding recess 933. A handle opening 965 in each end wall 928 is also arched to follow the upper and lower edges of the end wall 928.

FIG. 32 is a side view of the crate 910. As shown, the anti-shingling ribs 956, 962 extend downward below the upper band portion 916. The anti-shingling ribs 956, 962 are tapered toward the respective columns 918, 966.

Figure 33:
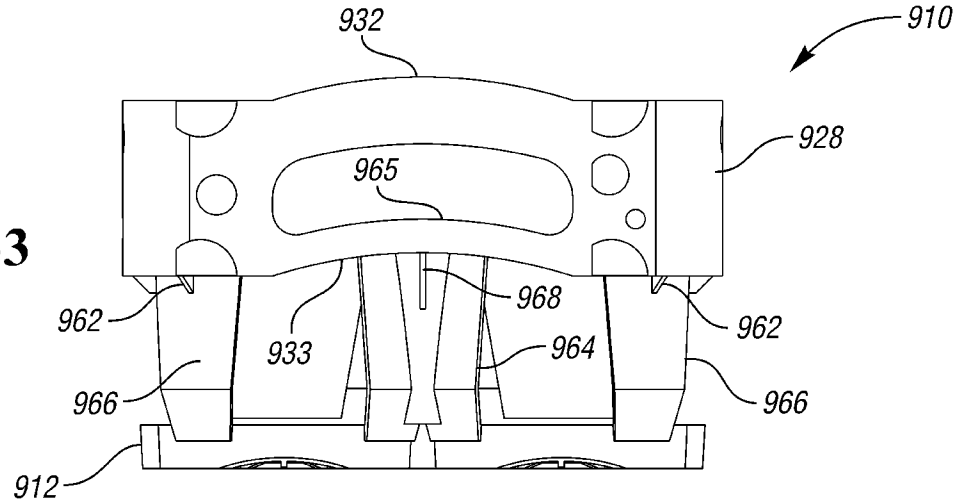
FIG. 33 is an end view of the crate of FIG. 31.

FIG. 33 is an end view of the crate 910. The other end would be the same. As shown, an anti-shingling rib 968 extends down below the handle opening 965 and the band portion along the end column 964 and is tapered toward the end column 964.

Figure 34:
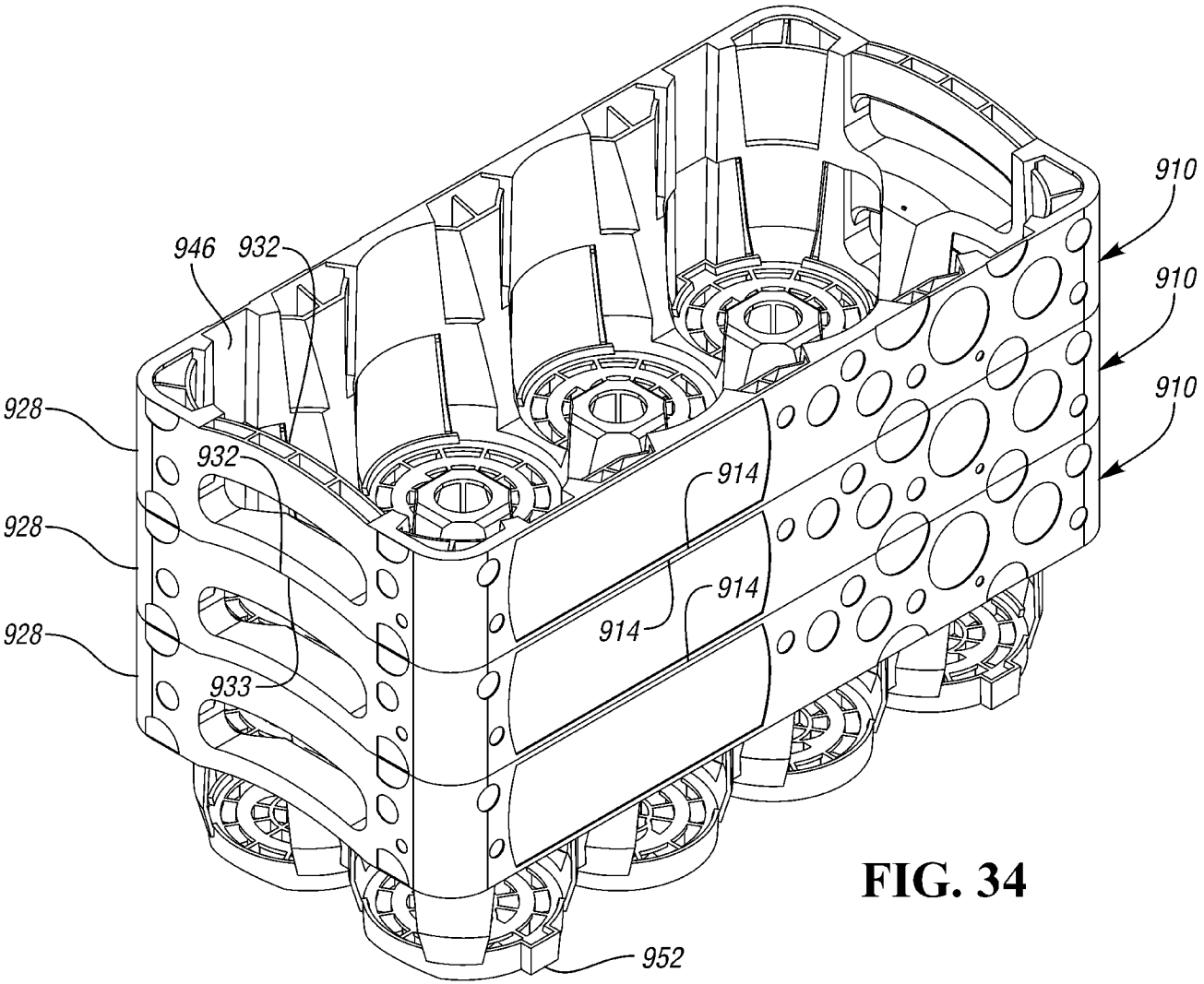
FIG. 34 is a perspective view of three of the crates of FIG. 31 nested together.

FIG. 34 shows three of the crates 910 empty and nested within one another. As shown, the straight upper and lower edges of the side walls 914 abut one another. On the end walls 928, the peaks 932 are received in the recesses 933 of the crate 910 above. Although not visible, the projections 952 in the base 912 of each crate 910 are received in the upper recesses 946 of the crate 910 below.

Figure 35:
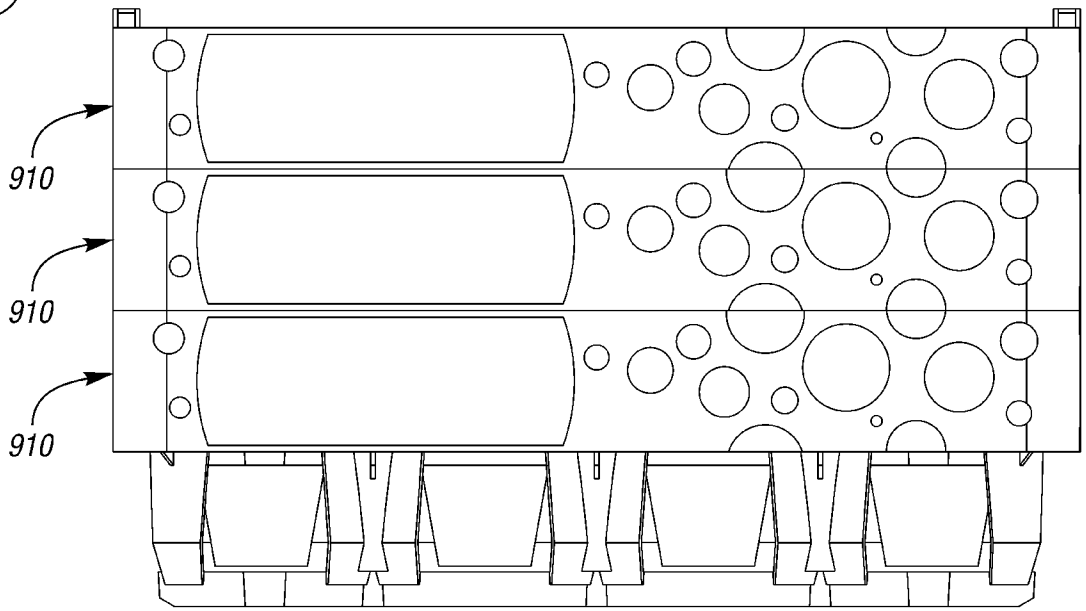
FIG. 35 is a side view of the crates of FIG. 34.
Figure 36:
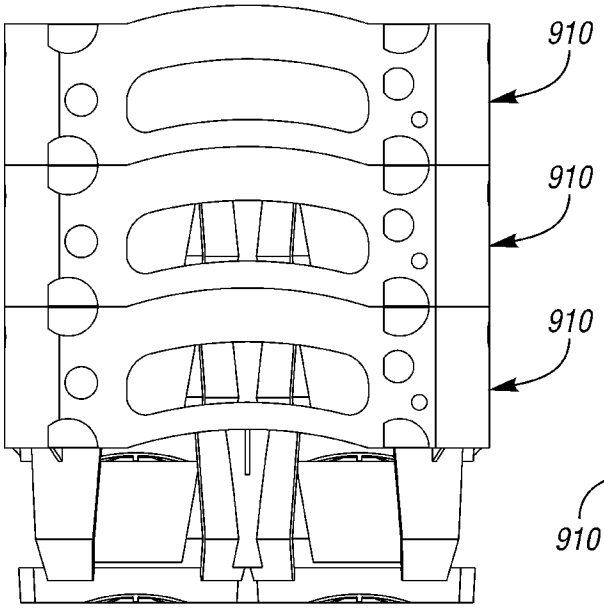
FIG. 36 is an end view of the crates of FIG. 34.

FIGS. 35 and 36 are side and end views, respectively, of the crates 910 of FIG. 34.

Figure 37:
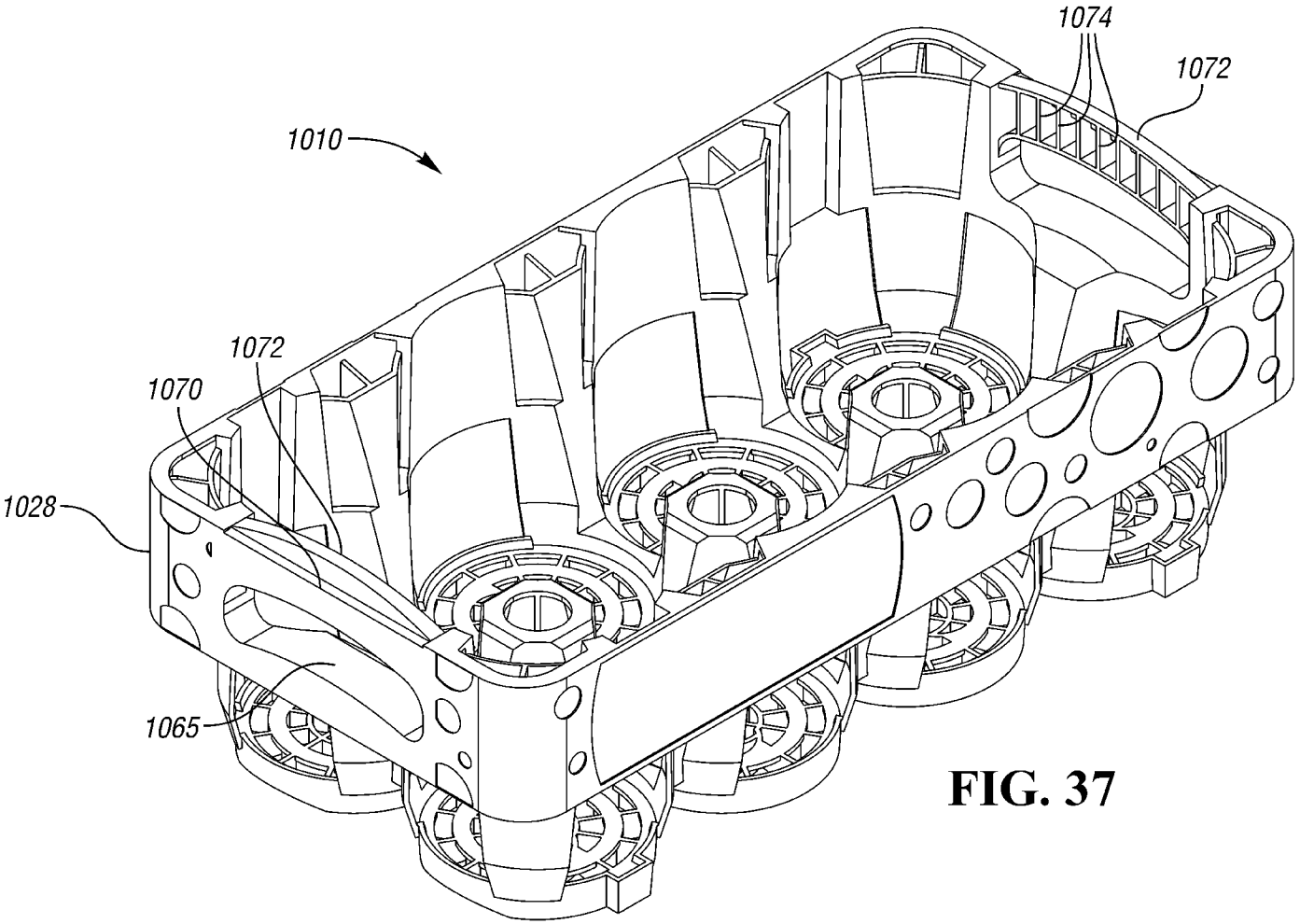
FIG. 37 is a perspective view of a crate according to an eleventh embodiment.

FIG. 37 shows an eleventh crate 1010. It is identical to the crate 910 of FIGS. 31-36, except as described below and/or shown in the Figures. The upper edge of each end wall 1028 includes an outer portion 1070 and an inner portion 1072. The inner portion 1072 projects upwardly higher than the outer portion 1070 to create a notch or step at the outer face of the upper end of the end wall 1028. The inner portion 1072 is arched to make the crate 1010 unstable when flipped upside-down (again, to prevent theft or misuse). The inner portion 1072 has a convex upper surface curving about an axis generally parallel to the long axis of the crate 1010. In this embodiment, the inner portion 1072 is cored from the interior of the crate 1010 during injection molding, also forming a plurality of ribs 1074 that separate recesses that are open to the interior of the crate 1010. The handle opening 1065 is also arched, or upwardly-convex. Interior columns partially define a plurality of bottle-receiving pockets. In this example, three interior columns partially define eight bottle-receiving pockets.

Figure 38:
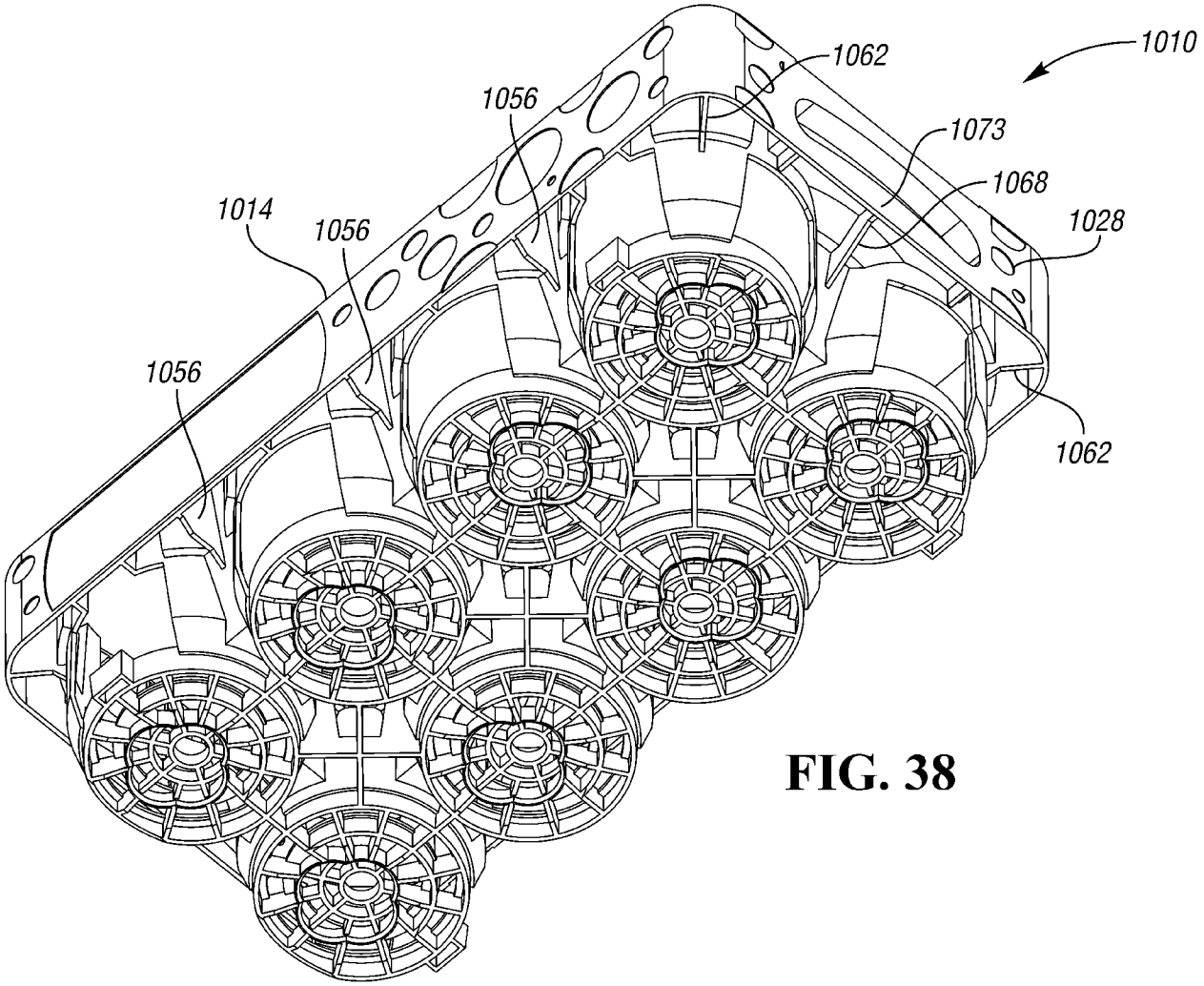
FIG. 38 is a bottom perspective view of the crate of FIG. 37.

FIG. 38 is a bottom perspective view of the crate 1010. The anti-shingling ribs 1056, 1062, 1068 are shown. A recess is defined behind the outer wall portion 1073 of the end wall 1028 and below an outer portion of the end anti-shingling rib 1068. The recess is aligned below the upwardly-projecting inner portion 1072 of the upper edge of the end wall 1028.

Figure 39:
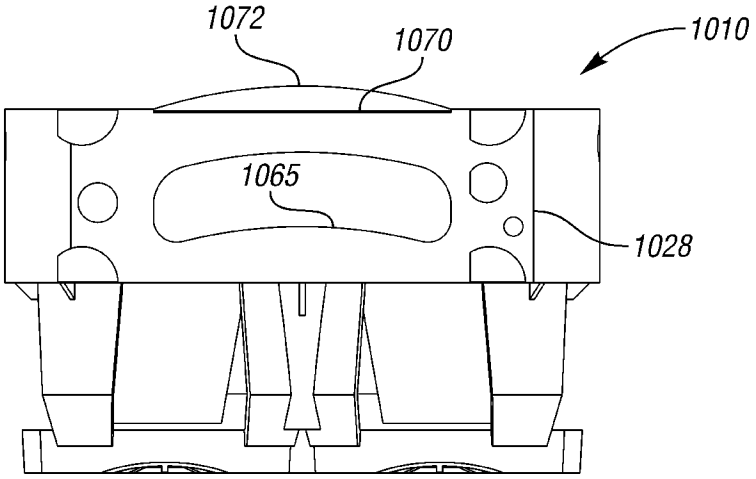
FIG. 39 is an end view of the crate of FIG. 37.
Figure 40:
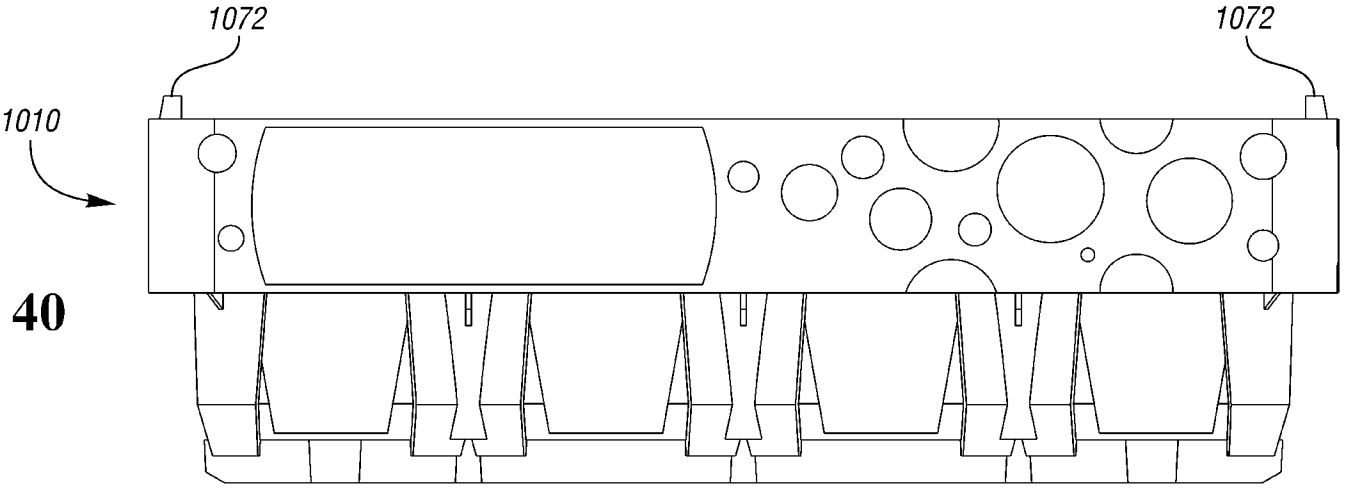
FIG. 40 is a side view of the crate of FIG. 37.

FIGS. 39 and 40 are end and side views, respectively, of the crate 1010. As shown, the inner portion 1072 projects above the rest of the crate 1010 in an arch.

Figure 42:
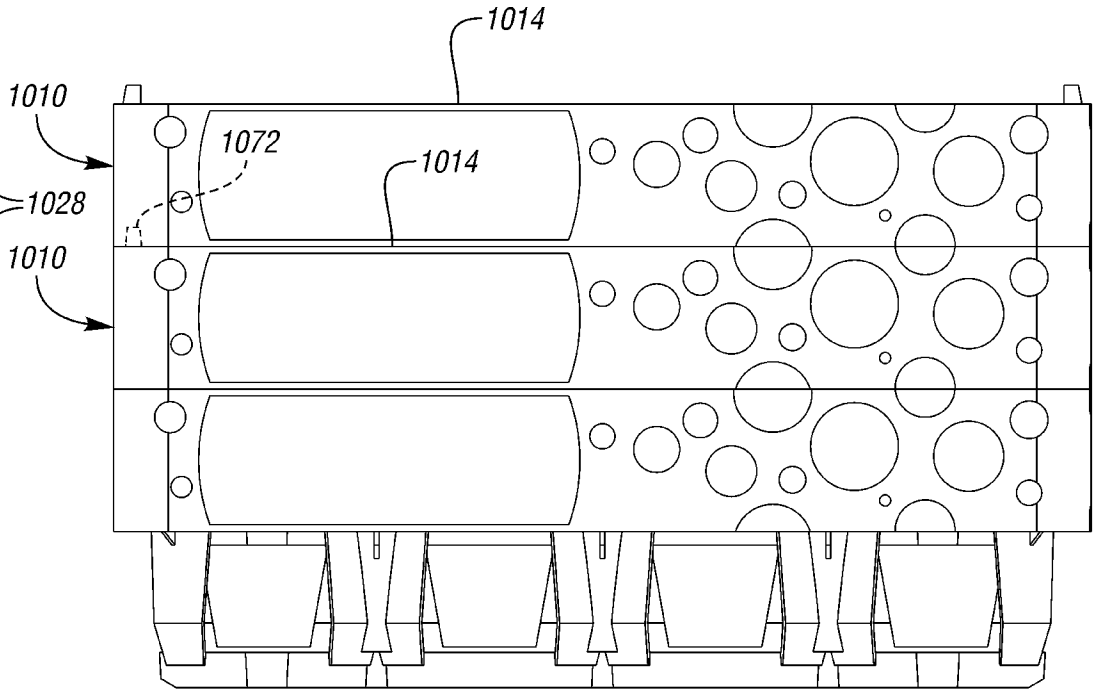
FIG. 42 is a side view of the crates of FIG. 41.
Figure 41:
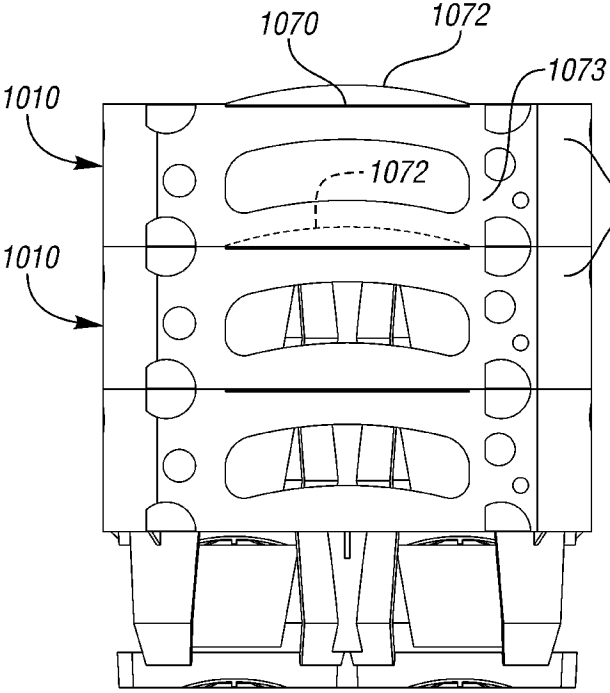
FIG. 41 is an end view of three of the crates of FIG. 37 nested together.
Figure 43:
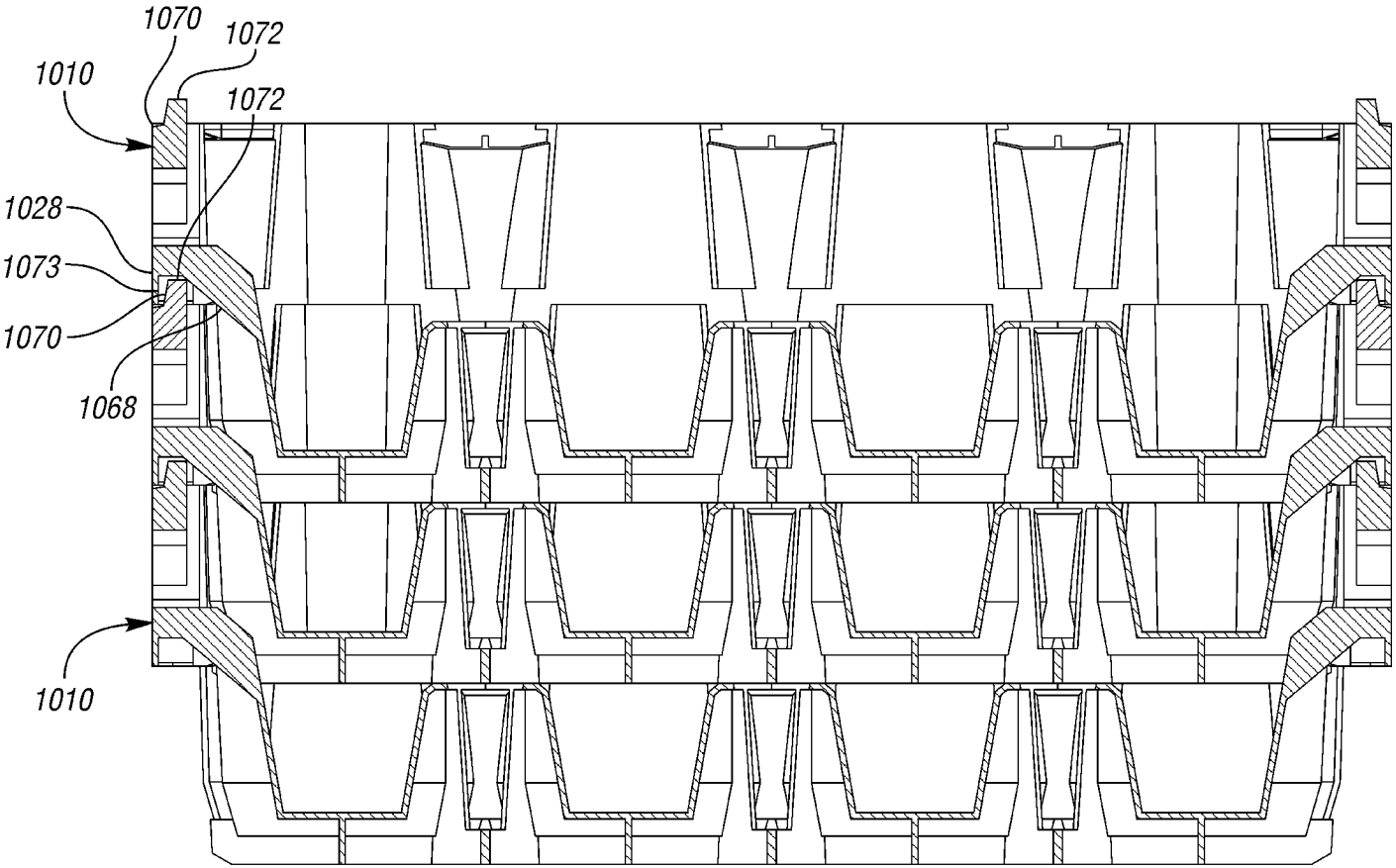
FIG. 43 is a section view through the crates of FIG. 42

FIGS. 41 and 42 show three empty crates 1010 nested together. As shown, the end walls 1028 and side walls 1014 of the upper and lower crates 1010 abut one another. The inner portions 1072 of the end walls 1028 of the lower crate 1010 are received behind the outer wall portion 1073 of the upper crate 1010. This is shown more clearly in FIG. 43, which is a section view through the stacked crates 1010. As shown, the outer wall portion 1073 of the upper crate 1010 contacts the outer portion 1070 of the lower crate 1010, with the inner portion 1072 of the lower crate 1010 received between the outer wall portion 1073 and the anti-shingling rib 1068 of the upper crate 1010.

Figure 44:
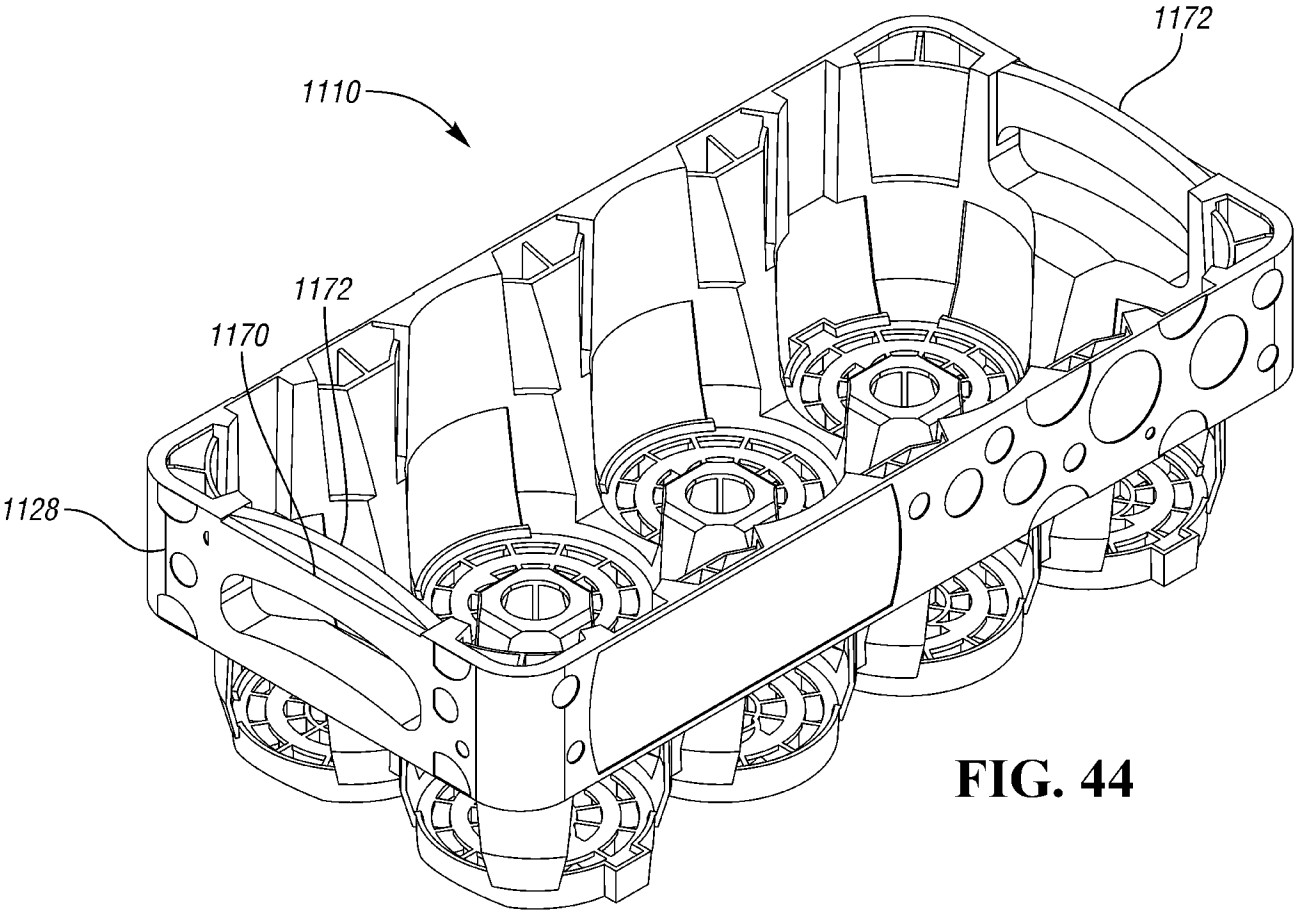
FIG. 44 is a perspective view of a crate according to a twelfth embodiment.

FIG. 44 shows a twelfth crate 1110, which is identical to the crate 1010 of FIGS. 37-43 except as shown in the Figures or described below. In this example, the inner portions 1172 of the end wall 1128 are formed by a gas-assist injection-molding method, so that the inner and outer portions 1172, 1170 have continuous walls surrounding a hollow interior.

Figure 45:
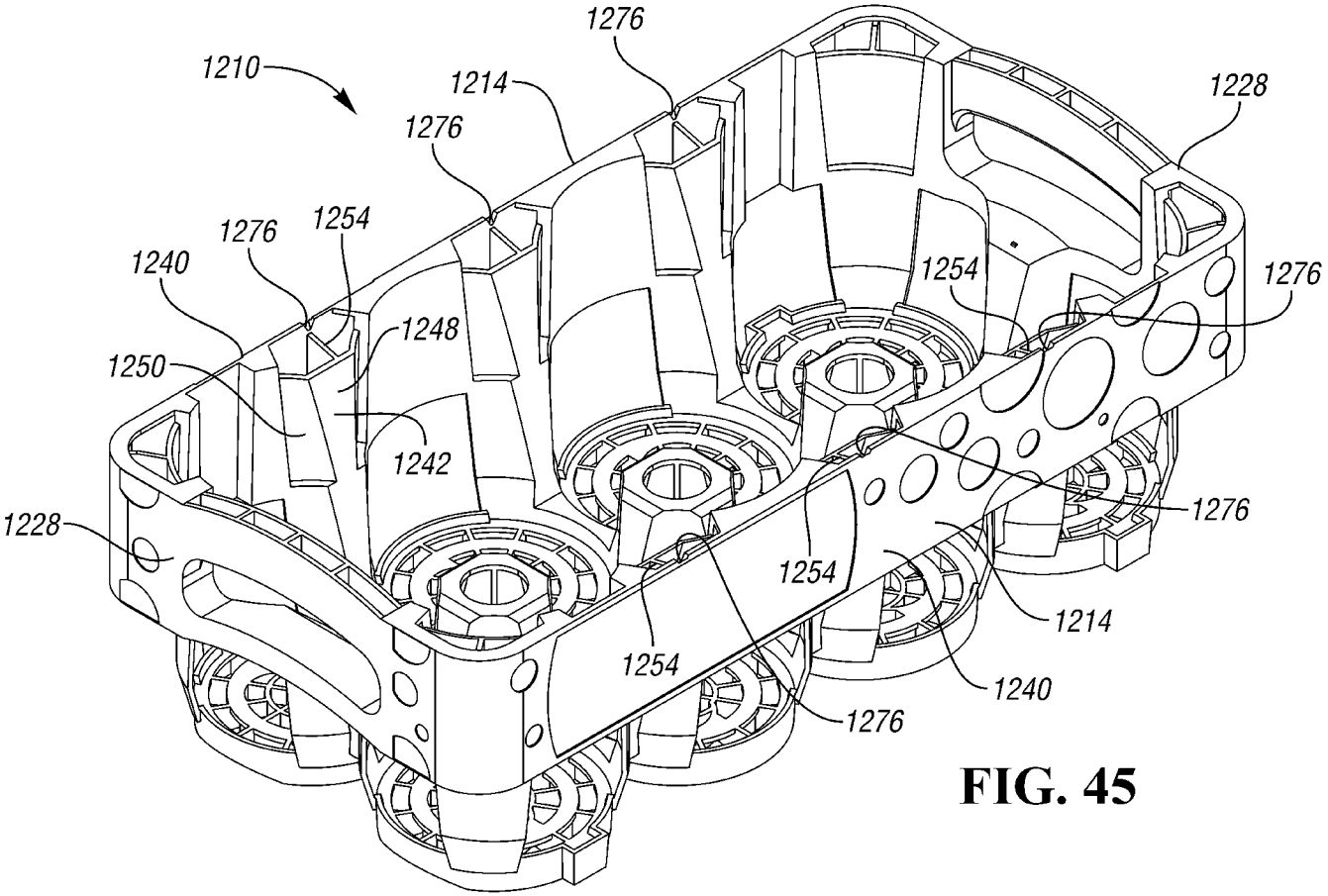
FIG. 45 is a perspective view of a crate according to a thirteenth embodiment.

FIG. 45 shows a thirteenth crate 1210, which is identical to the crate 910 of FIGS. 31-36 except as shown in the Figures or described below. In this embodiment, the ribs 1254 extending between the angled inner wall portion 1248 of the upper dividers 1242 and the outer wall portion 1240 of the side walls 1214 are offset from the centers of the upper dividers 1242. The ribs 1254 on one side wall 1214 are offset toward one end wall 1228, while the ribs 1254 on the other side wall 1214 are offset toward the other end wall 1228. A small notch 1276 is formed in the upper edge of the outer wall portion 1240 aligned with each rib 1254 of the upper dividers 1242. Since the ribs 1254 are offset toward different end walls 1228, so are the notches 1276. Interior columns partially define a plurality of bottle-receiving pockets. In this example, three interior columns partially define eight bottle-receiving pockets.

Figure 46:
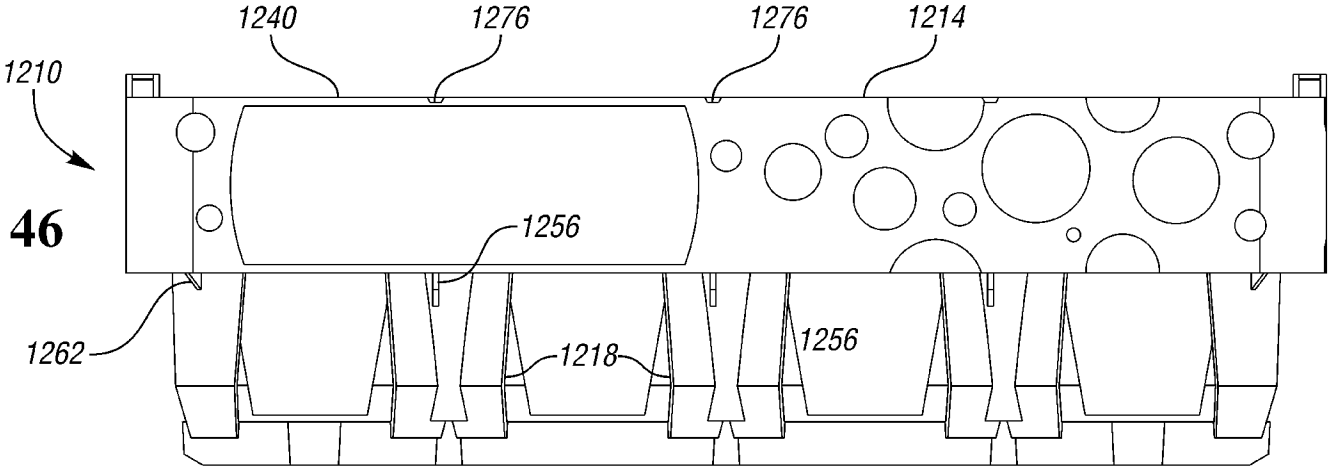
FIG. 46 is a side view of the crate of FIG. 45.

FIG. 46 is a side view of the crate 1210. The anti-shingling ribs 1256, which are contiguous with the ribs 1254 (FIG. 45) are likewise offset from the center of each column 1218 toward one of the end walls 1228. The anti-shingling ribs 1256 on the other side wall 1214 would be offset toward the other end wall 1228. The notches 1276 are aligned with the anti-shingling ribs 1256.

Figure 47:
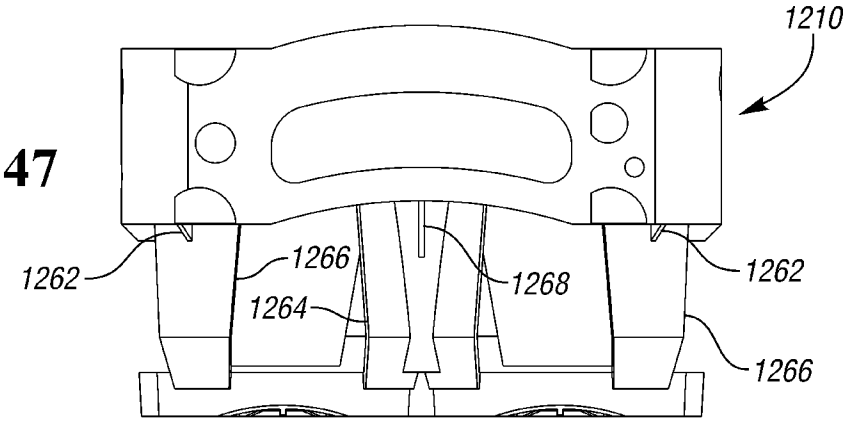
FIG. 47 is an end view of the crate of FIG. 45.

FIG. 47 is an end view of the crate 1210. The anti-shingling ribs 1268, 1262 are not offset in this example, but optionally, they could be offset (although it is less advantageous than offsetting those on the side wall).

Figure 48:
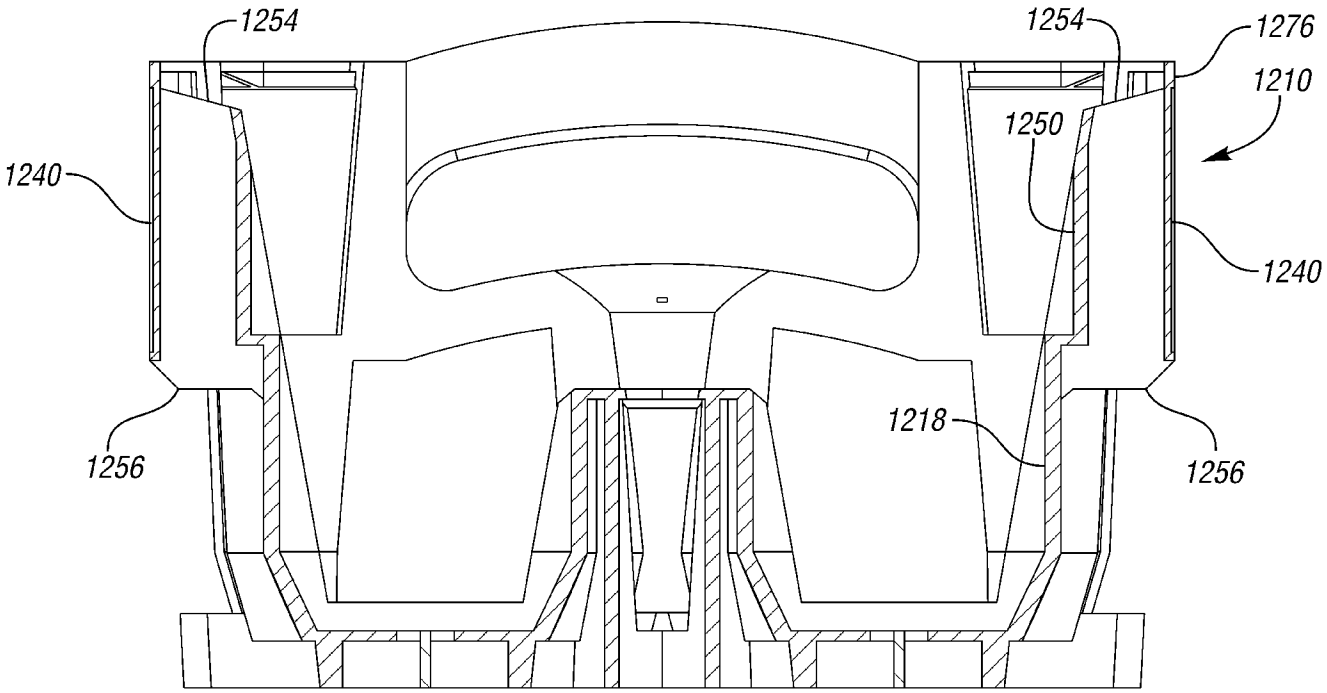
FIG. 48 is a section view through the crate of FIG. 47.

FIG. 48 is a section view through the crate 1210, taken through one of the notches 1276 on one of the side walls 1214. As shown, the notches 1276 on one side wall 1214 do not align with notches 1276 on the other side wall 1214, because they are offset toward different end walls 1228. The ribs 1254 are contiguous with the anti-shingling ribs 1256, and are really just upper and lower portions of the same rib or wall.

Figure 49:
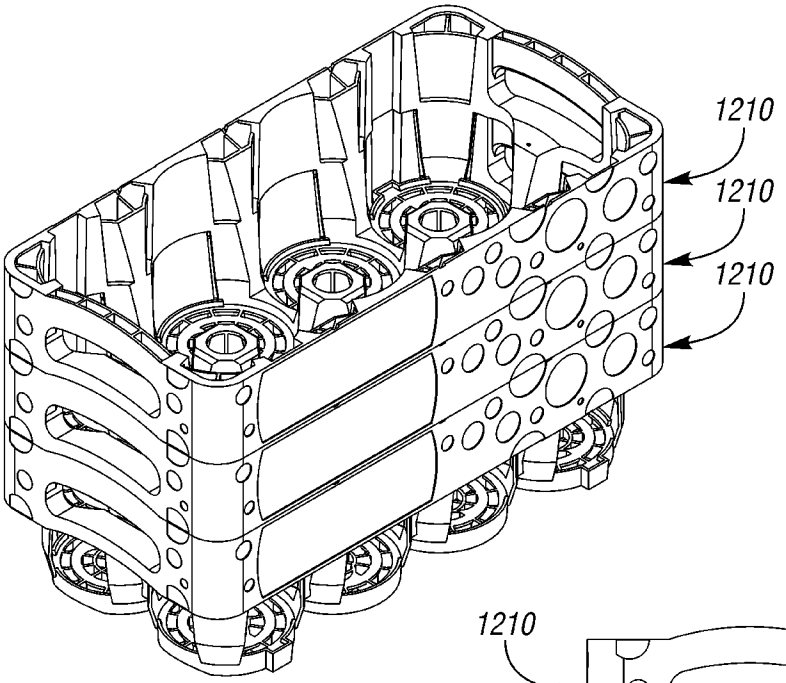
FIG. 49 is a perspective view of three of the crates of FIG. 47 nested together.
Figure 50:
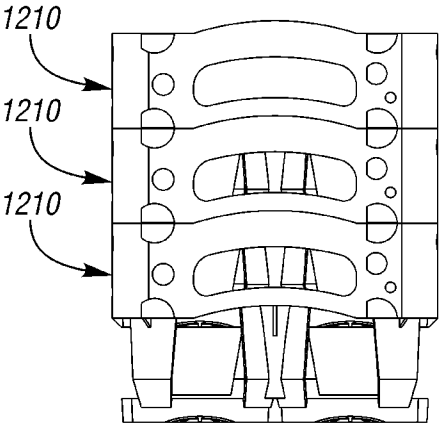
FIG. 50 is an end view of the crates of FIG. 49.
Figure 51:
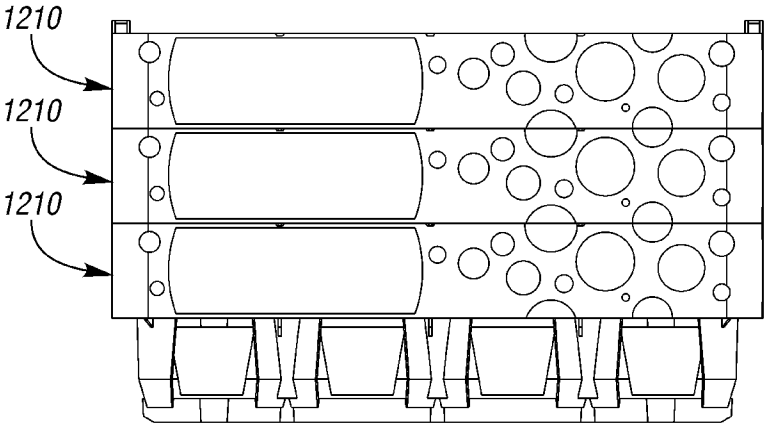
FIG. 51 is a side view of the crates of FIG. 49.

FIGS. 49, 50 and 51 show three of the empty crates 1210 nested with one another to reduce storage volume and height.

Figure 52:
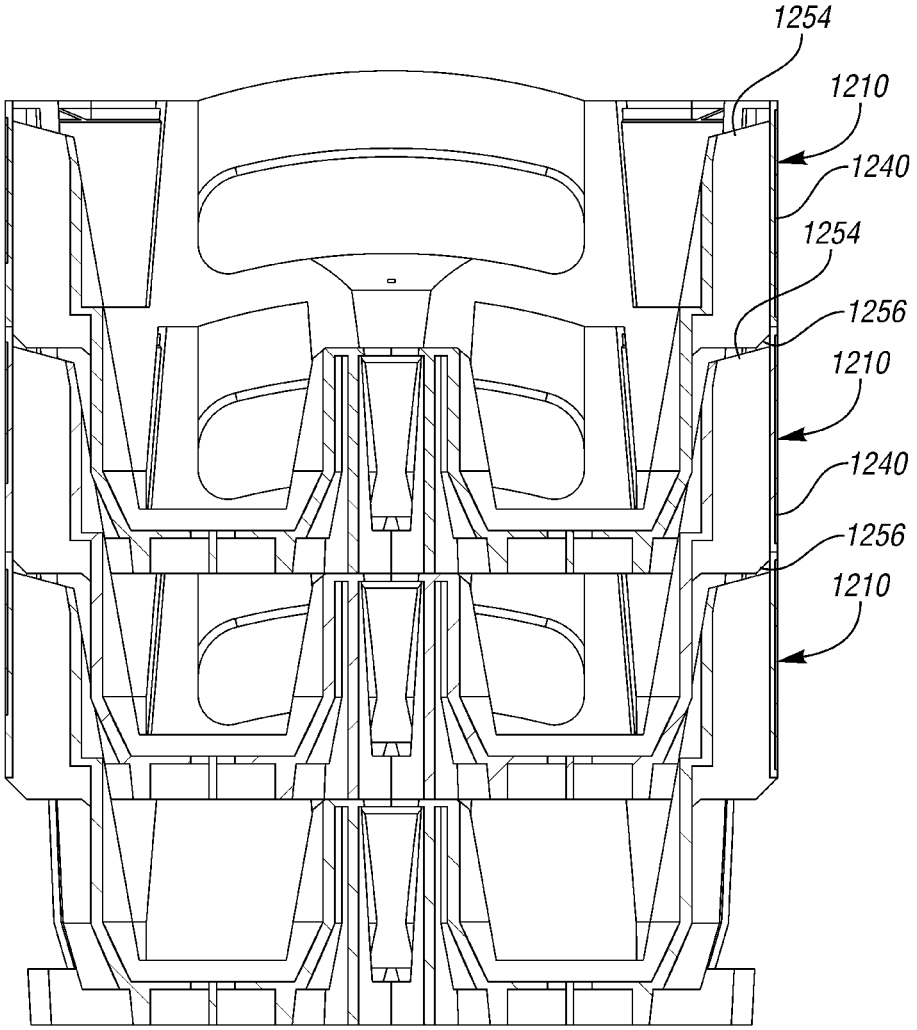
FIG. 52 is a section view through the crates of FIG. 51.

FIG. 52 is a section view through the stack of crates 1210 of FIG. 49. As shown, the anti-shingling ribs 1256 of the upper crate 1210 may abut the rib 1254 of the crate 1210 below. The notches 1276 provide additional clearance for the anti-shingling ribs 1256 when the crates 1210 are nested. The base 1212 of the upper crate 1210 may abut the interior columns of the crate 1210 below.

Figure 53:
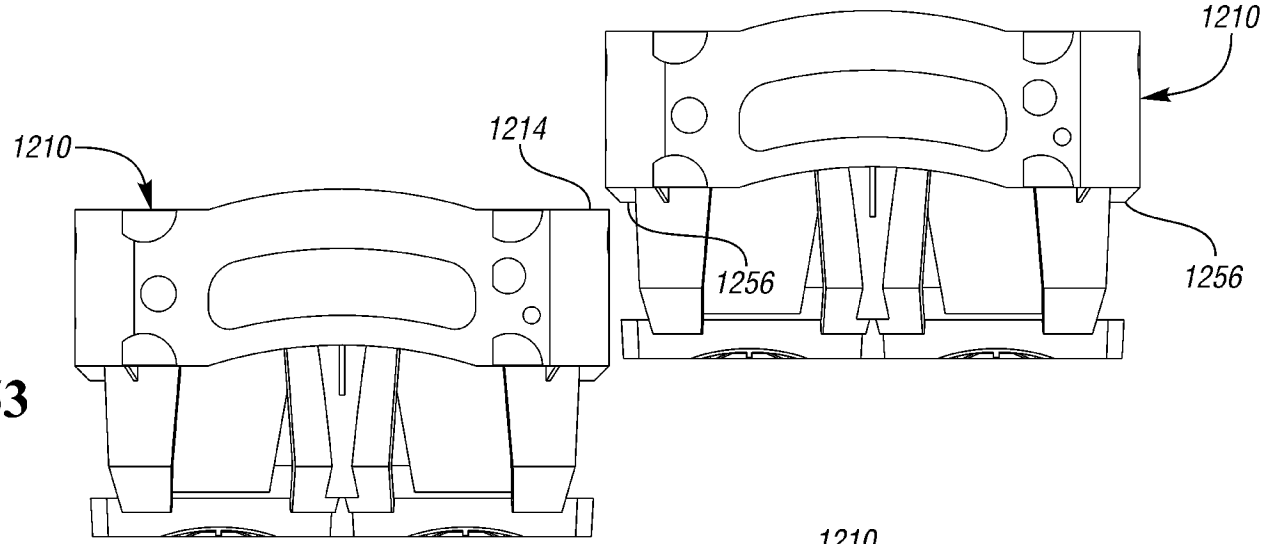
FIG. 53 illustrates the anti-shingling feature with two of the crates of FIG. 47.
Figure 54:
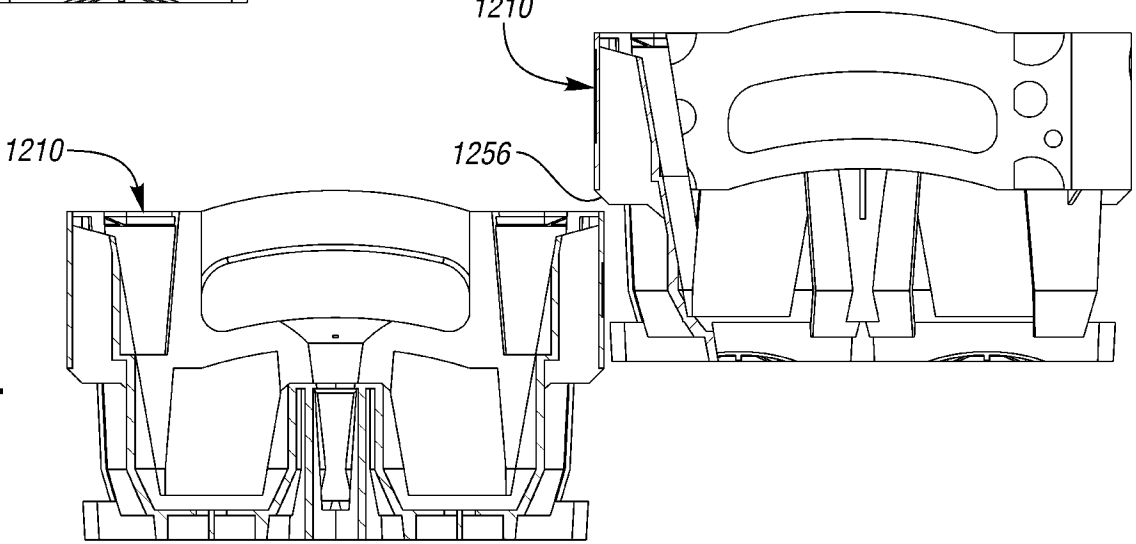
FIG. 54 is a section view through the crates of FIG. 53.

FIGS. 53 and 54 show the operation of the anti-shingling ribs 1256. The bottom tapered portions of the anti-shingling ribs 1256 may contact the side walls 1214 of an adjacent crate 1210 when a stack of crates 1210 (just one empty crate is shown) is set next to another stack of loaded crates (just one empty crate is shown). The angled edges of the anti-shingling ribs 1256 cause the crate 1210 to move away from the adjacent crate 1210 as it is being lowered onto the floor or pallet. Because the anti-shingling ribs 1256 and notches 1276 of the abutting side walls 1214 of the adjacent crates 1210 are offset in different directions, the anti-shingling ribs 1256 of the one crate 1210 will not align with the notches 1276 of the other crate 1210. The notches 1276 would otherwise somewhat reduce the effectiveness of the anti-shingling ribs 1256, were they to be aligned, because the anti-shingling ribs 1256 would not move the crate 1210 laterally as far as it is being lowered.

Figure 55:
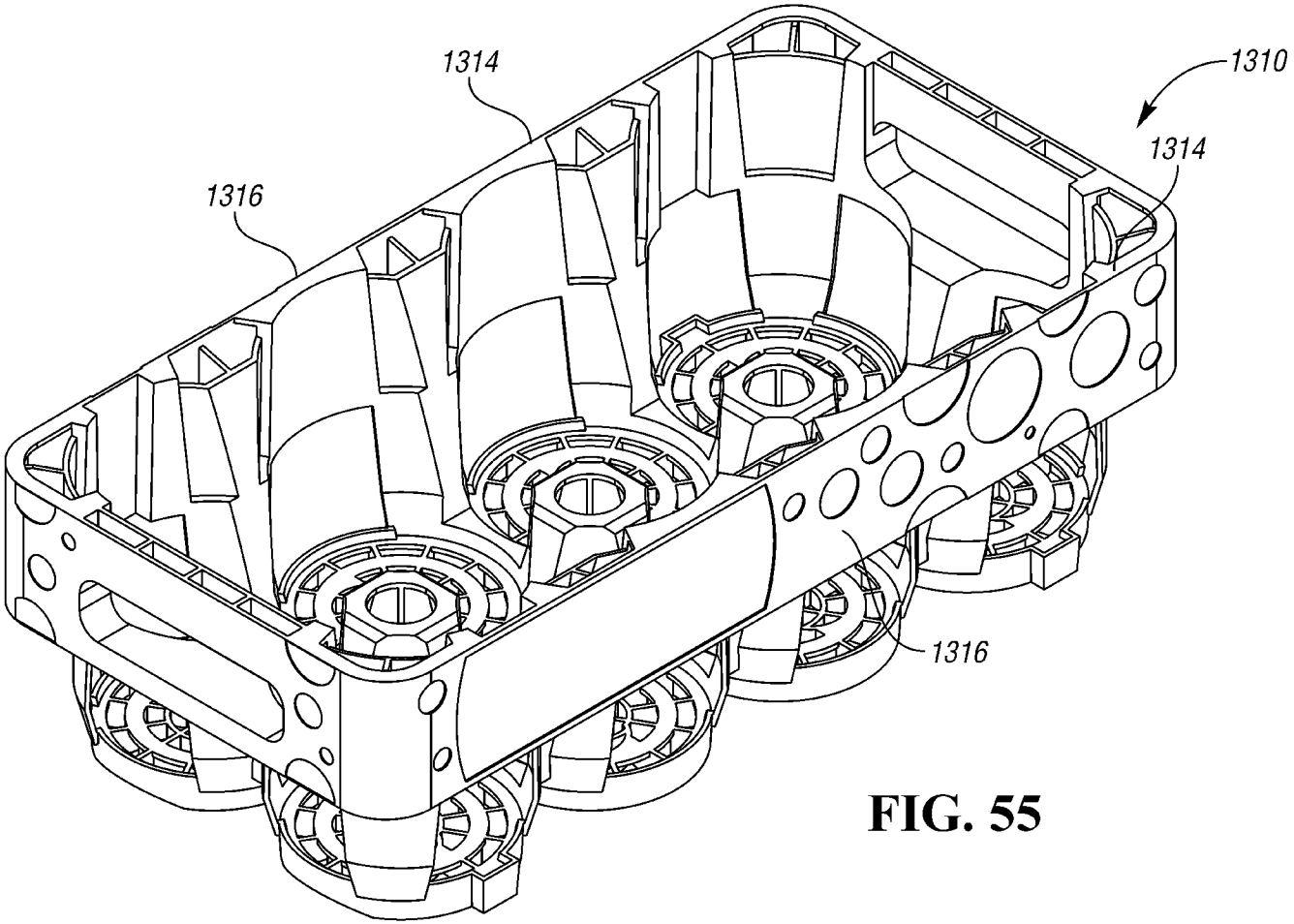
FIG. 55 is a perspective view of a crate according to a fourteenth embodiment.

FIG. 55 shows a fourteenth crate 1310, which is identical to the crate 910 of FIGS. 31-36 except as shown in the Figures or described below. In this crate 1310, the upper and lower edges of the bands 1316 of the side walls 1314 are straight, flat and parallel to one another.

Figure 56:
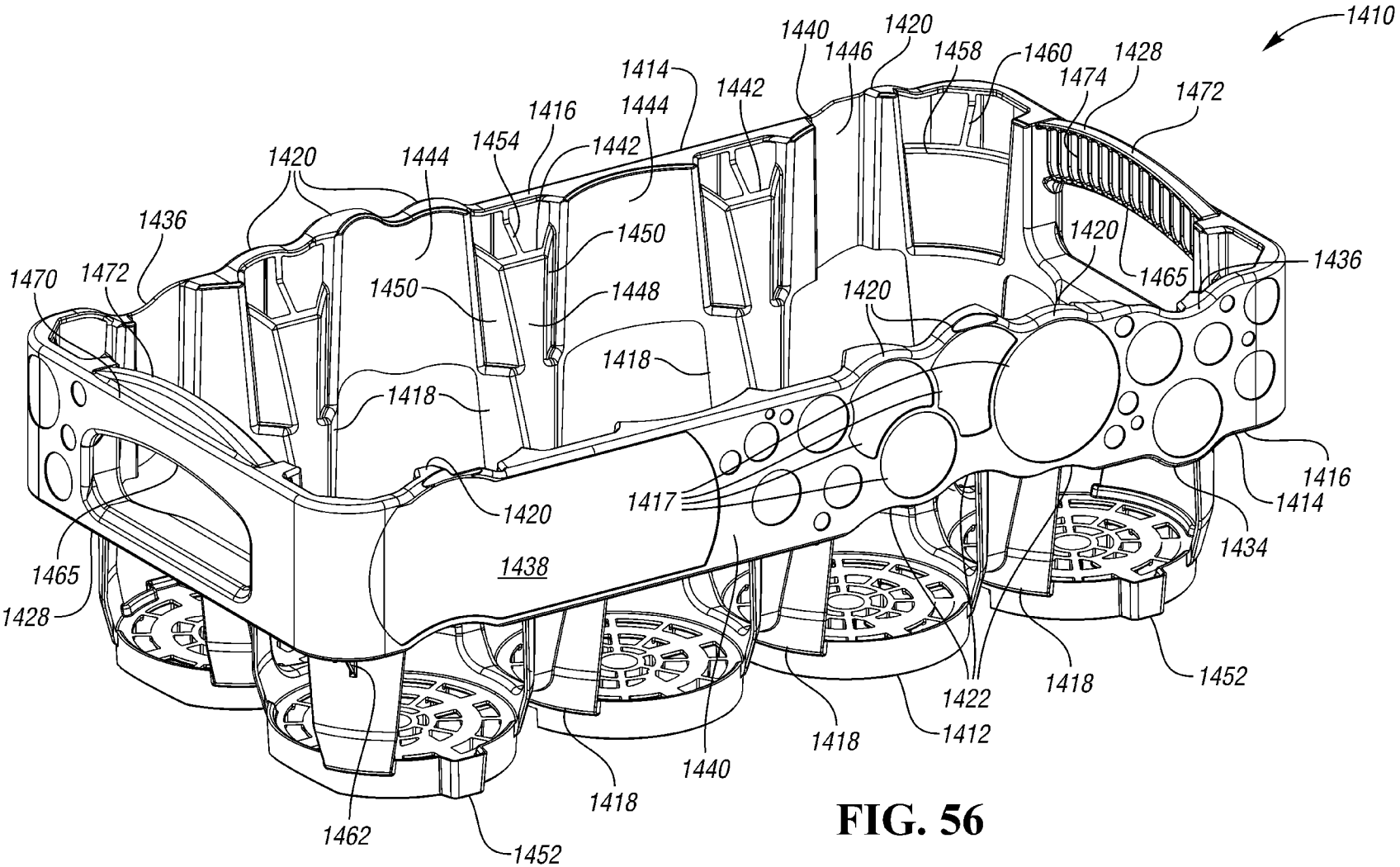
FIG. 56 is a perspective view of a crate according to a fifteenth embodiment.

A fifteenth crate 1410 is shown in FIGS. 56-61. Referring to FIG. 56, the crate 1410 includes a base 1412 with side walls 1414 and end walls 1428 extending upward from the base 1412. Interior columns partially define a plurality of bottle-receiving pockets. In this example, three interior columns partially define eight bottle-receiving pockets. The side walls 1414 include a band portion 1416 connected to the base 1412 by inwardly-offset columns 1418. As shown, the band portion 1416 of the side wall 1414 is asymmetrical (left to right) and has upper and lower edges that rise and fall together to form a plurality of peaks 1420 extending upward at the upper edge and corresponding recesses 1422 formed on the lower edge of the band portion 1416. The upper edge of the band portion 1416 on each side wall is complementary to the lower edge. The lower edge of the band portion 1416 also includes a lower peak 1434 extending downward. A complementary recess 1436 is formed in the upper edge of the band portion 1416 above the peak 1434. A logo field 1438 is formed in the band portion 1416.

The peaks 1420 other than the peak 1420 in the logo field 1438 are each formed as a portion of a circle design 1417 molded into the exterior surface of the band portion 1416 to form an image of a bubble, which is suggestive of the contents of the bottles to be carried in the crate 1410. Other circle designs 1417 are also formed in the exterior surface of the band portion 1416. The peaks 1420, 1434 and recesses 1422, 1436 are formed asymmetrically (left to right) in the band portion 1416. The two side walls 1414 may be identical, as shown (or alternatively, mirror image). The upward and downward peaks 1420, 1434 increase the effective height of the band portion 1416, thereby reducing shingling without increasing nesting height. The crate 1410 is injection molded as a single piece of suitable plastic.

The upper band portion 1416 includes an outer wall portion 1440 in which the circle designs 1417 and the logo field 1438 are formed. The peaks 1420, 1434 and recesses 1422, 1436 are all formed in the outer wall portion 1440. The upper band portion 1416 includes a plurality of upper dividers 1442 (in this example, three on each side wall 1414) aligned above each column 1418.

Between the three upper dividers 1442 in each side wall 1414 are two concave inner wall portions 1444 which would align with two of the bottle receiving areas. The inner wall portions 1444 are spaced inward of the outer wall portion 1440 defining a cavity therebetween and forming a double-walled portion. In this embodiment, some of the peaks 1420 are formed in both the inner wall portion 1444 and the outer wall portion 1440, with a connecting upper wall connecting upper edges thereof. Outward of the three upper dividers 1442 (between the upper divider 1442 and the corner of the crate 1410) is a pair of upper recesses 1446 which define a single-walled portion (i.e. only the outer wall portion 1440 separates the exterior from the interior of the crate 1410).

Figure 57:
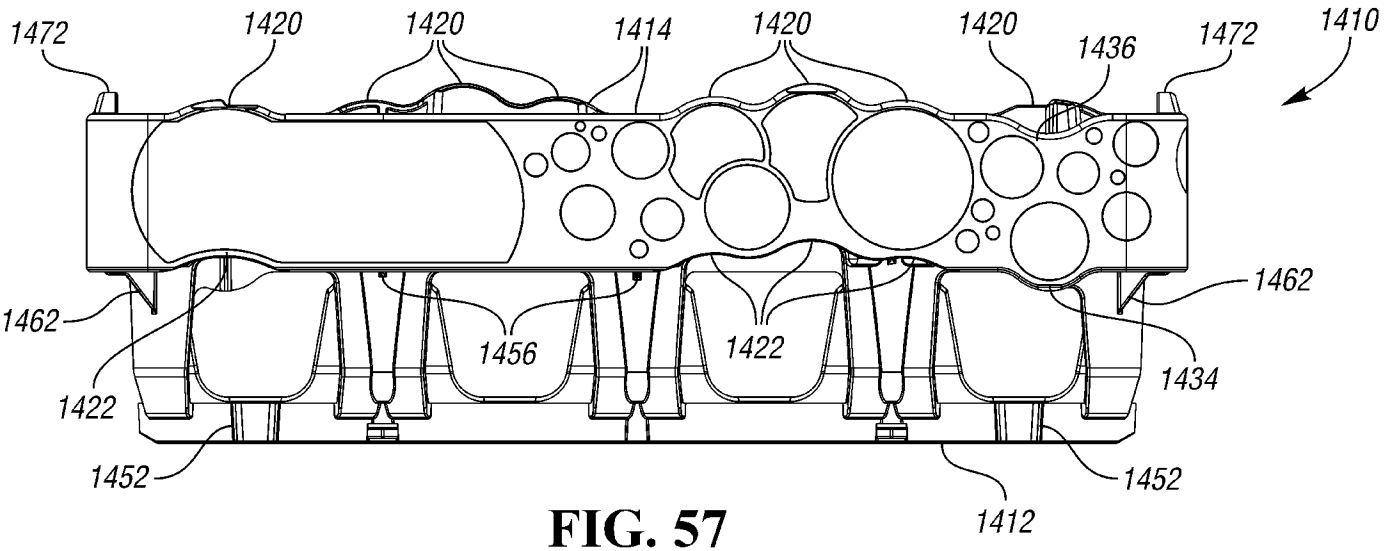
FIG. 57 is a side view of the crate of FIG. 56.

Each upper divider 1442 includes an angled inner wall portion 1448 and a pair of angled side walls 1450. The angled side walls 1450 extend outward toward the exterior of the crate 10 further than the adjacent edge of the concave inner wall portion 1444, to create a jut or ridge at the juncture. A rib 1454 extends from the angled inner wall portion 1448 to the outer wall portion 1440 of the upper band portion 1416. The rib 1454 and angled side walls 1450 are spaced below upper edges of the outer wall portion 1440. The rib 1454 extends down below the upper band portion 1416 to form an anti-shingling rib portion 1456 (FIG. 57). The ribs 1454 could optionally be offset, as described above with respect to FIG. 45. Inner wall portions 1458 in each of the corners of the crate 1410 also have a rib 1458 extending to the outer wall portion 1440 and extend down to form an anti-shingling rib portion 1462.

The base 1412 includes at least one (and may include a plurality, as shown) of lugs or projections 1452, projecting toward the exterior of the crate 1410 generally in the plane of the base 1412. The projections 1452 are aligned with the upper recesses 1446.

The end walls 1428 also include a band portion connected to the base 1412 by inwardly-offset columns. The upper edge of each end wall 1428 includes an outer portion 1470 and an inner portion 1472. The inner portion 1472 projects upwardly higher than the outer portion 1470 to create a notch or step at the outer face of the upper end of the end wall 1428. The inner portion 1472 is arched and has a convex upper surface to make the crate 1410 unstable when flipped upside-down (again, to prevent theft or misuse). The inner portion 1472 has a convex upper surface curving about an axis generally parallel to the long axis of the crate 1410. In this embodiment, the inner portion 1472 is cored from the interior of the crate 1410 during injection molding, also forming a plurality of ribs 1474 that separate recesses that are open to the interior of the crate 1410. The handle opening 1465 is also arched, or has a concave upper surface.

Figure 58:
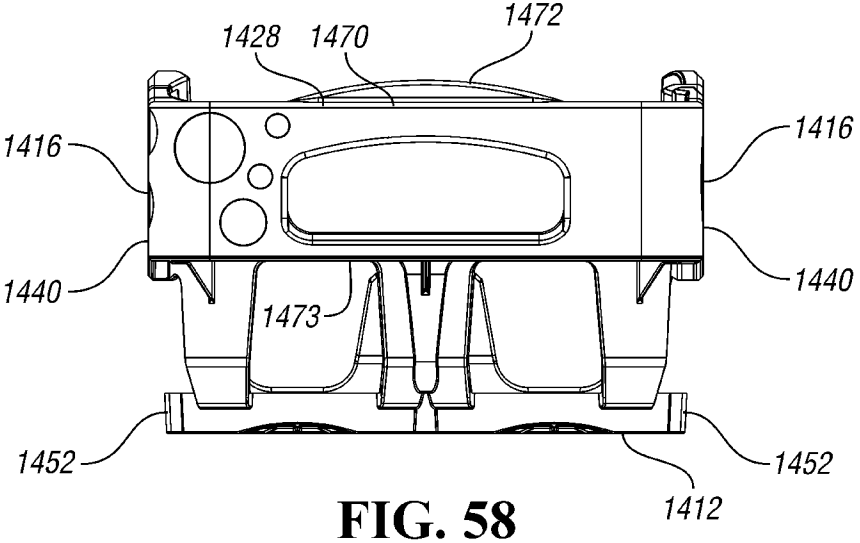
FIG. 58 is an end view of the crate of FIG. 57.

FIG. 57 is a side view of the crate 1410, showing that the opposite side walls 1414 are identical (not mirror image in this example). The peaks 1420 are aligned with complementary recesses 1422. The peak 1434 is aligned with complementary recess 1436. FIG. 58 is an end view of the crate 1410. The projections 1452 project outward less than the band portions 1416 of the side walls 1414, so that they can be received between the outer wall portions 1440 of an identical crate 1410 into which it is nested, as shown in FIG. 59.

Figure 59:
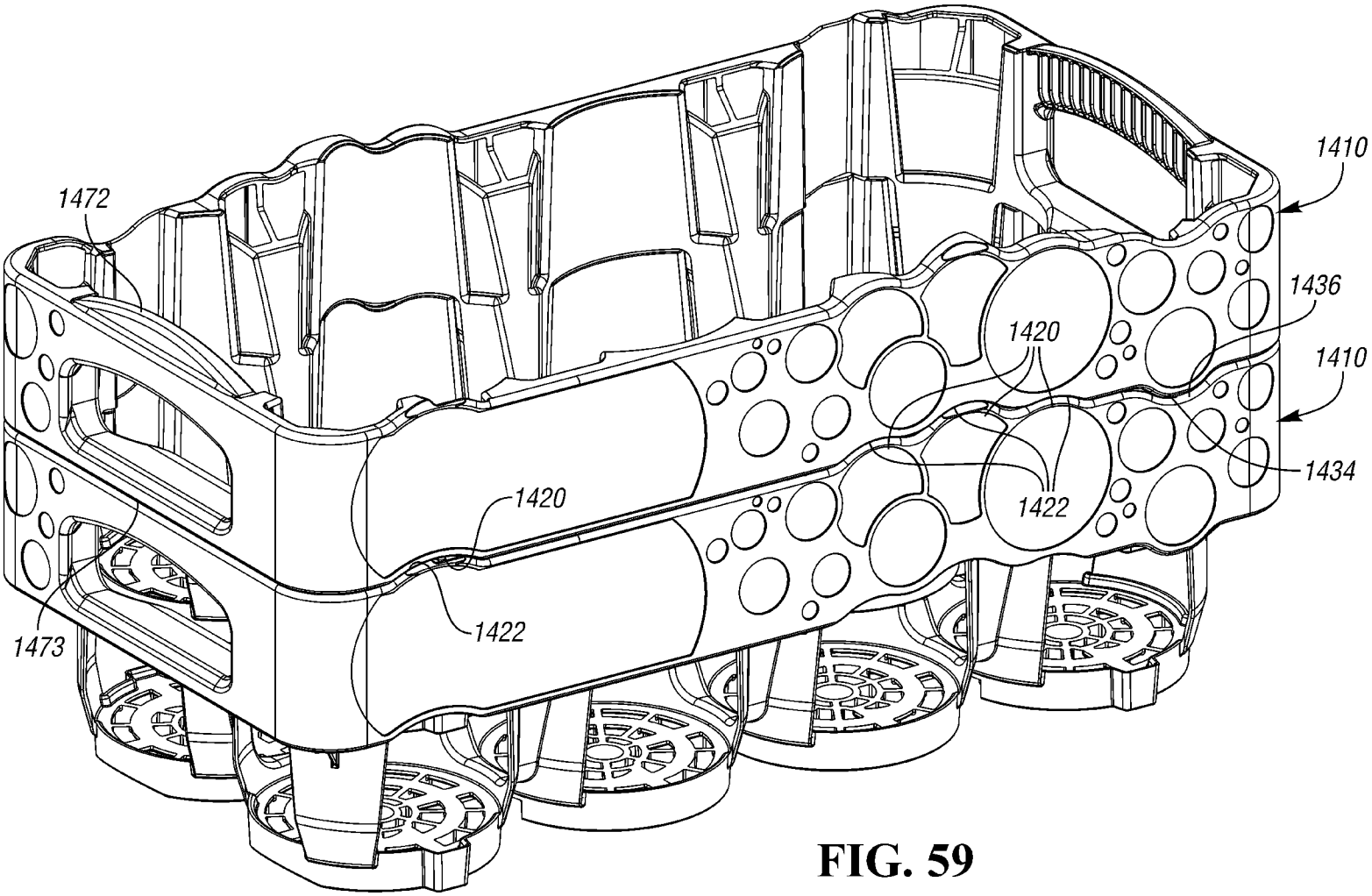
FIG. 59 shows two of the crates of FIG. 56 nested together.

FIG. 59 shows two of the crates 1410 empty and nested within one another. As shown, the peaks 1420 on the upper edge of the band portion 1416 are received in the recesses 1422 on the lower edge of the band portion 1416 of the crate 1410 above. The peak 1434 on the lower edge of the band portion 1416 is received in the recess 1436 in the upper edge of the band portion 1416 on the crate 1410 below. The inner portions 1472 of the end walls 1428 of the lower crate 1410 are received behind the outer wall portion 1473 of the upper crate 1410. Although not visible, the projections 1452 in the base 1412 of each crate 1410 are received in the upper recesses 1446 of the crate 1410 below.

Figure 60:
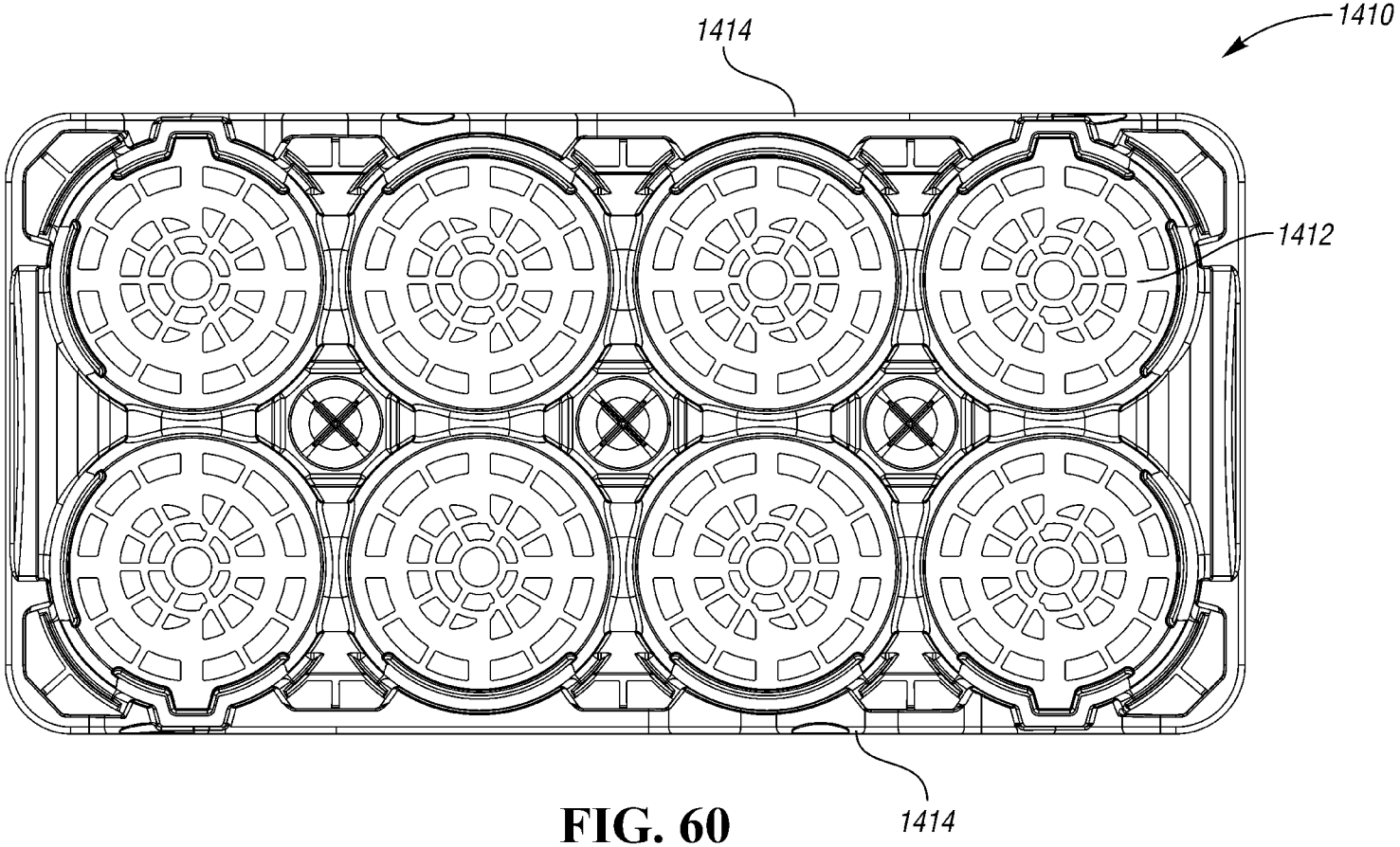
FIG. 60 is a top view of the crate of FIG. 56.
Figure 61:
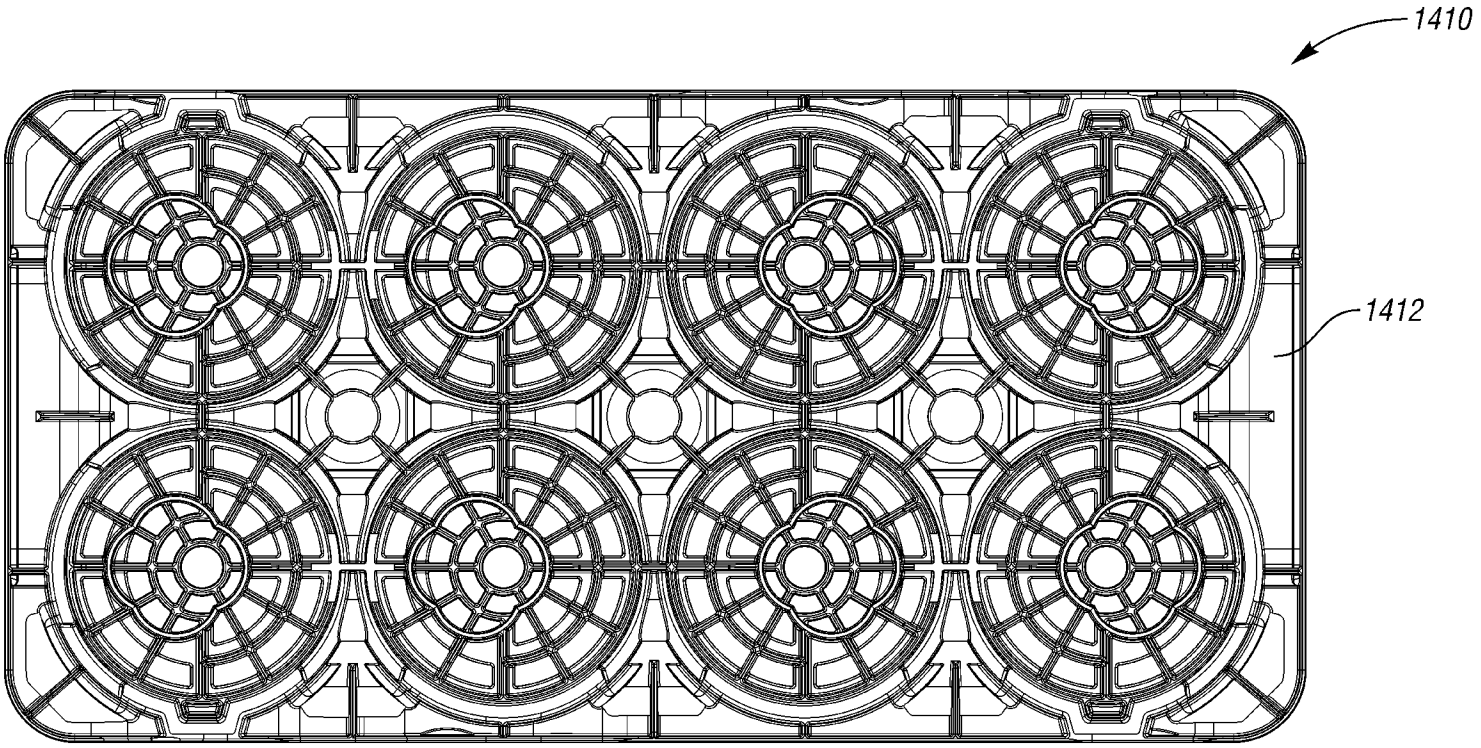
FIG. 61 is a bottom view of the crate of FIG. 56.

FIGS. 60 and 61 are top and bottom views, respectively, of the crate 1410.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, several of the features described herein could be used in combination. The offset anti-shingling ribs could be used with the asymmetric band designs. The notches could be used with any of the designs and could be offset with the anti-shingling ribs. The handle options described above are interchangeable with one another, although with different benefits. Each of the crates described above is preferably injection molded as a single piece of suitable plastic. Each of the example crates described above includes three interior columns partially defining eight bottle-receiving pockets; however, some of these features may be beneficially used on other types of beverage crates, such as crates without interior columns or interior dividers.

What is claimed is:

1. A beverage crate comprising:

a base having opposed end edges and opposed side edges;

a pair of end walls extending upward from the end edges of the base; and a pair of side walls extending upward from the side edges of the base, each of the side walls including an upper band portion connected to the base by inwardly-offset columns, wherein each of the upper band portions is asymmetrical, the upper band portions each including portions with straight upper edges and straight lower edges, the upper band portions each including at least one upper peak protruding upwardly higher than the upper edges and at least one complementary lower recess aligned below the at least one upper peak, the upper band portions each including at least one lower peak protruding downwardly lower than the lower edges and at least one complementary upper recess aligned above the at least one lower peak.

2. The crate of claim 1 wherein the upper band portions each include an outer wall portion and a concave inner wall portion spaced inward of the outer wall portion, wherein the inner wall portion and the outer wall portion include the at least one upper peak.

3. The crate of claim 1 further including a plurality of interior columns extending upward from the base between the pair of end walls and between the pair of side walls.

4. The crate of claim 1 wherein the upper band portions each include an outer wall portion, the crate further including a plurality of upper dividers each having an angled inner wall portion and a rib extending from the outer wall portion to the angled inner wall portion, the rib spaced downward from an upper edge of the outer wall portion.

5. The crate of claim 4 further including a plurality of anti-shingling ribs extending below the upper band portions and exterior of the columns, wherein each of the plurality of anti-shingling ribs is coplanar and contiguous with the rib extending from the outer wall portion to the angled inner wall portion.

6. The crate of claim 1 wherein the upper band portion on one of the side walls is identical to the upper band portion of the other of the side walls.

7. The crate of claim 1 wherein each of the upper band portions is asymmetrical.

8. The crate of claim 1 wherein each end wall includes an upper edge having an outer portion and an inner portion, each end wall including a handle opening therethrough, wherein the inner portion projects upwardly higher than the outer portion above the handle opening.

9. The crate of claim 8 wherein the inner portion has a convex upper surface.

10. The crate of claim 1 further including a first partial logo formed on an outer surface of each upper band portion above the at least one complementary lower recess aligned and a second partial logo formed on the outer surface of each upper band portion below the at least one upper peak, such that when the crate is nested into an identical crate below, the first partial logo of the crate forms a logo together with the second partial logo of the identical crate below.

11. The crate of claim 1 further including at least one bubble logo molded into an outer surface of each of the upper band portions, wherein the at least one bubble logo is formed partially on the at least one upper peak.

12. The crate of claim 1 further including at least one lug projecting outward from the base in a plane parallel to the base along an axis generally parallel to the end edges of the base.

13. The crate of claim 12 wherein the upper band portion includes at least one recess for receiving the at least one lug of an identical crate nested therein.

14. A beverage crate comprising:

a base having opposed end edges and opposed side edges;

a pair of end walls extending upward from the end edges of the base, each end wall including a handle opening therethrough, each end wall including an upper edge having an outer portion and an inner portion, wherein the inner portion projects upwardly higher than the outer portion above the handle opening, wherein the inner portion has a convex upper surface curving about an axis generally parallel to the side edges of the base, wherein all of the convex upper surface is higher than a remainder of the each end wall; and a pair of side walls extending upward from the side edges of the base, each of the side walls including an upper band portion connected to the base by inwardly-offset columns.

15. The crate of claim 14 wherein the inner portion has a plurality of ribs facing an interior of the crate.

16. The crate of claim 15 wherein the plurality of ribs are generally vertical.

17. The crate of claim 14 wherein the inner portion has a plurality of ribs facing an interior of the crate.

18. A beverage crate comprising:

a base having opposed end edges and opposed side edges;

a pair of end walls extending upward from the end edges of the base;

a pair of side walls extending upward from the side edges of the base, each of the side walls including an upper band portion connected to the base by inwardly-offset side columns;

a plurality of corner columns in corners of the crate connecting the upper band portions to the base; and a plurality of anti-shingling ribs extending below the upper band portions and exterior of the side columns, the anti-shingling ribs on one of the side walls offset from centers of the side columns toward one of the end walls.

19. The crate of claim 18 wherein the anti-shingling ribs on the other of the side walls are offset from centers of the side columns toward the other of the end walls.

20. The crate of claim 19 further including notches formed in uppermost edges of the upper band portions in alignment with the anti-shingling ribs.

21. The crate of claim 20 further including a plurality of interior columns extending upward from the base between the pair of end walls and between the pair of side walls.

22. The crate of claim 18 wherein the plurality of anti-shingling ribs are tapered downward from the upper band portions toward the respective side columns.

* * * * *